US012628990B2

(12) United States Patent
Lang

(10) Patent No.: US 12,628,990 B2
(45) **Date of Patent: *May 19, 2026**

(54) DISPENSER ASSEMBLY

(71) Applicant: DEB IP LIMITED, Denby (GB)

(72) Inventor: Christopher James Lang, Nottinghamshire (GB)

(73) Assignee: DEB IP LIMITED, Denby (GB)

( * ) Notice: Subject to any disclaimer, the term of this patent is extended or adjusted under 35 U.S.C. 154(b) by 316 days.

This patent is subject to a terminal disclaimer.

(21) Appl. No.: 18/237,072

(22) Filed: Aug. 23, 2023

(65) Prior Publication Data

US 2023/0389756 A1 Dec. 7, 2023

Related U.S. Application Data

(63) Continuation of application No. 17/496,173, filed on Oct. 7, 2021, now Pat. No. 11,744,413.

(51) Int. Cl.
*A47K 5/13* (2006.01)

(52) U.S. Cl.
CPC ..... *A47K 5/13* (2013.01); *A47K 2201/025* (2013.01)

(58) Field of Classification Search
CPC ..... A47K 5/13; A47K 2201/025; A47K 5/12; A47K 2010/3246; E05B 1/0038; E05B 63/0056; E05B 63/0065
See application file for complete search history.

(56) References Cited

U.S. PATENT DOCUMENTS

| | | | |
|---|---|---|---|
| 2,898,009 | A | 8/1959 | Green |
| 3,458,090 | A | 7/1969 | Scoggin, Jr. |
| 3,540,630 | A | 11/1970 | Brown |
| 3,633,787 | A | 1/1972 | Katz |
| 3,861,568 | A | 1/1975 | Morris et al. |
| 3,971,237 | A | 7/1976 | Rasmussen |
| 4,036,406 | A | 7/1977 | Jespersen et al. |
| 4,084,729 | A | 4/1978 | Epple |
| 4,171,545 | A | 10/1979 | Kann |

(Continued)

FOREIGN PATENT DOCUMENTS

| | | | |
|---|---|---|---|
| AU | 448780 | B | 1/1972 |
| AU | 2015410275 | A1 | 4/2018 |

(Continued)

OTHER PUBLICATIONS

Chinese Office Action from corresponding Application No. 202280075997.X mailed on Sep. 28, 2024, 34 pages.

(Continued)

*Primary Examiner* — Frederick C Nicolas
*Assistant Examiner* — Michael J. Melaragno
(74) *Attorney, Agent, or Firm* — Quarles & Brady LLP

(57) ABSTRACT

A dispenser includes a body coupled to a front panel to form an interior cavity. The body includes a sidewall extending from a back portion. An opening is formed through the sidewall at a location spaced apart from the back portion. A housing extends from the sidewall adjacent the opening and into the interior cavity. In addition, a lock is configured to be received within the housing in a first orientation or a second orientation, the lock having a wall that is positioned within the opening in the second orientation. Further, the wall includes a receptacle formed therethrough.

20 Claims, 14 Drawing Sheets

(56) References Cited

U.S. PATENT DOCUMENTS 4,391,111 A 7/1983 Marcy
4,408,811 A 10/1983 Richardson et al.
4,424,916 A 1/1984 Pearson
4,493,440 A 1/1985 Von Buelow
4,611,768 A 9/1986 Voss et al.
4,621,749 A 11/1986 Kanfer
4,651,902 A 3/1987 Hobbs et al.
4,667,854 A 5/1987 McDermott et al.
4,673,109 A 6/1987 Cassia
4,874,113 A 10/1989 Schmidt
4,921,150 A 5/1990 Lagergren
4,938,384 A 7/1990 Pilolla et al.
4,964,544 A 10/1990 Hanna et al.
4,978,036 A 12/1990 Burd
5,033,657 A 7/1991 Whittington
5,099,785 A 3/1992 Reed
5,115,945 A 5/1992 Ruck
5,154,496 A 10/1992 Campbell
5,156,293 A 10/1992 Petterson et al.
5,170,958 A 12/1992 Brown
5,183,182 A 2/1993 Comstock et al.
5,248,066 A 9/1993 Olson et al.
5,253,786 A 10/1993 Schmidt
5,377,871 A 1/1995 Banks et al.
5,413,251 A 5/1995 Adamson
5,431,309 A 7/1995 Ophardt
5,435,465 A 7/1995 El-Amin
5,445,288 A 8/1995 Banks
5,465,877 A 11/1995 Bell et al.
5,480,068 A 1/1996 Frazier et al.
5,492,247 A 2/1996 Shu et al.
5,501,372 A 3/1996 Daansen
5,556,005 A 9/1996 Banks
5,598,952 A 2/1997 Daansen
5,632,418 A 5/1997 Brown
5,649,676 A 7/1997 Lord
5,687,434 A 11/1997 Tagg
5,690,495 A 11/1997 Collier
5,765,242 A 6/1998 Marciano
5,836,482 A 11/1998 Ophardt et al.
5,842,609 A 12/1998 Higgins et al.
5,845,870 A 12/1998 Angle
5,857,594 A 1/1999 Ozturk
5,871,113 A 2/1999 Conway
5,901,921 A 5/1999 Perlsweig
5,937,599 A 8/1999 Gerischer et al.
5,966,753 A 10/1999 Gauthier et al.
5,988,440 A 11/1999 Saunders et al.
6,015,125 A 1/2000 Fischer
6,032,128 A 2/2000 Morrison
6,036,056 A 3/2000 Lee et al.
6,042,288 A 3/2000 Rattinger et al.
6,047,262 A 4/2000 Lutz
6,066,607 A 5/2000 Gordon et al.
6,105,866 A 8/2000 Morrison
6,112,857 A 9/2000 Morrison
6,131,773 A 10/2000 Wade et al.
6,145,629 A 11/2000 Addy
6,155,486 A 12/2000 Lutz
6,189,740 B1 2/2001 Wade et al.
6,206,238 B1 3/2001 Ophardt
6,209,184 B1 4/2001 Copeland
6,209,752 B1 4/2001 Mitchell et al.
6,296,184 B1 10/2001 Dejaeger
6,325,245 B1 12/2001 Matthews
6,343,739 B1 2/2002 Lippert
6,347,724 B1 2/2002 Chen et al.
6,354,497 B1 3/2002 Lippert
6,363,355 B1 3/2002 Morrison
6,390,363 B1 5/2002 Morrison et al.
6,408,279 B1 6/2002 Mason
6,409,081 B1 6/2002 Nugent, Jr.
6,427,839 B1 8/2002 Helfer-Grand
6,427,914 B1 8/2002 Snyder
6,427,915 B1 8/2002 Wike, Jr. et al.
6,431,400 B1 8/2002 O'Maley et al.
6,502,749 B1 1/2003 Snyder
6,516,976 B2 2/2003 Lewis et al.
6,530,520 B1 3/2003 Snyder et al.
6,533,145 B2 3/2003 Lewis et al.
6,540,137 B1 4/2003 Forsythe et al.
6,588,549 B2 7/2003 Wike, Jr. et al.
6,602,573 B2 8/2003 Pezzato
6,607,103 B2 8/2003 Gerenraich
6,619,509 B2 9/2003 DeKoning et al.
6,619,512 B1 9/2003 Sayers
6,695,174 B2 2/2004 Sorensen et al.
6,701,573 B1 3/2004 Ciavarella et al.
6,707,873 B2 3/2004 Thompson et al.
6,729,502 B2 5/2004 Lewis et al.
6,729,503 B2 5/2004 DeKoning et al.
6,764,369 B2 7/2004 Lai et al.
6,772,328 B1 8/2004 Talbot
6,772,916 B1 8/2004 Reynolds
6,869,041 B1 3/2005 Allegre
6,877,642 B1 4/2005 Maddox et al.
6,902,950 B2 6/2005 Ma et al.
6,977,588 B2 12/2005 Schotz et al.
6,991,066 B2 1/2006 Persky
6,997,345 B2 2/2006 Mitchell
7,011,271 B2 3/2006 Walters
7,040,566 B1 5/2006 Rodrian et al.
7,044,328 B1 5/2006 Ciavarella
7,051,987 B2 5/2006 Chen
7,066,356 B2 6/2006 Schuman et al.
7,066,357 B2 6/2006 Ciavarella et al.
7,084,592 B2 8/2006 Rodrian
7,086,567 B1 8/2006 Ciavarella et al.
7,107,630 B2 9/2006 Noro et al.
7,114,639 B2 10/2006 Lewis et al.
7,198,177 B2 4/2007 Ganzeboom
7,207,461 B2 4/2007 Mitchell et al.
7,232,045 B2 6/2007 Ophardt et al.
7,234,612 B2 6/2007 Ophardt
7,247,140 B2 7/2007 Ophardt
7,255,200 B1 8/2007 Walter
7,278,554 B2 10/2007 Armstrong
7,287,720 B1 10/2007 Allegre et al.
7,296,765 B2 11/2007 Rodrian
7,316,369 B2 1/2008 Phelps
7,367,477 B2 5/2008 Ophardt et al.
7,374,066 B2 5/2008 Jackson et al.
7,375,640 B1 5/2008 Plost
7,416,117 B1 8/2008 Morrison
7,416,152 B2 8/2008 Wieser
7,458,523 B2 12/2008 Hyslop
7,488,338 B2 2/2009 Eidenschink
7,497,103 B1 3/2009 Misner
7,527,178 B2 5/2009 Lewis
7,530,477 B2 5/2009 Ophardt
7,540,397 B2 6/2009 Muderlak et al.
7,597,122 B1 10/2009 Smith
7,611,033 B2 11/2009 Ganzeboom
7,637,391 B2 12/2009 Rosenkranz et al.
7,654,417 B2 2/2010 Rhodenbaugh
7,726,521 B2 6/2010 Bassett
7,730,561 B2 6/2010 Kostelyk
7,748,574 B2 7/2010 Ophardt et al.
7,765,916 B2 8/2010 Ophardt et al.
7,774,871 B1 8/2010 Arsenault
7,798,370 B2 9/2010 Ciavarella
7,798,371 B2 9/2010 Ophardt
7,896,196 B2 3/2011 Wegelin et al.
7,909,209 B2 3/2011 Reynolds et al.
7,963,475 B2 6/2011 Rodrian
7,980,777 B2 7/2011 Kennedy et al.
7,984,829 B2 7/2011 Cittadino et al.
7,984,832 B2 7/2011 Pivonka
7,992,804 B2 8/2011 Nauels
7,997,443 B2 8/2011 Titas et al.
7,997,522 B2 8/2011 Titas et al.
8,009,015 B2 8/2011 Sayers et al.
8,047,403 B2 11/2011 Quinlan et al.
8,047,404 B2 11/2011 Quinlan et al.

(56) References Cited

U.S. PATENT DOCUMENTS

| | | | |
|---|---|---|---|
| 8,061,565 | B1 | 11/2011 | Baker |
| 8,091,738 | B2 | 1/2012 | Ciavarella |
| 8,096,445 | B2 | 1/2012 | Yang |
| 8,104,650 | B2 | 1/2012 | Lang et al. |
| 8,113,388 | B2 | 2/2012 | Ophardt et al. |
| 8,141,184 | B2 | 3/2012 | Mondrush |
| 8,160,742 | B2 | 4/2012 | Goerg et al. |
| 8,167,168 | B2 | 5/2012 | Reynolds |
| 8,201,707 | B2 | 6/2012 | Ophardt |
| 8,215,523 | B2 | 7/2012 | Ophardt |
| 8,235,689 | B2 | 8/2012 | Ciavarella |
| 8,245,881 | B2 | 8/2012 | Ophardt |
| 8,251,409 | B2 | 8/2012 | Chang et al. |
| 8,261,941 | B2 | 9/2012 | Woo et al. |
| 8,261,950 | B2 | 9/2012 | Cittadino et al. |
| 8,276,784 | B2 | 10/2012 | Ciavarella et al. |
| 8,302,812 | B2 | 11/2012 | Reynolds |
| 8,308,027 | B2 | 11/2012 | Law et al. |
| 8,313,010 | B2 | 11/2012 | Quinlan et al. |
| 8,328,046 | B2 | 12/2012 | Hochtritt et al. |
| 8,336,740 | B1 | 12/2012 | Daansen |
| 8,342,364 | B2 | 1/2013 | Bertucci |
| 8,342,368 | B2 | 1/2013 | Ophardt |
| 8,342,369 | B2 | 1/2013 | Hsu |
| 8,348,101 | B2 | 1/2013 | Ciavarella et al. |
| 8,365,954 | B2 | 2/2013 | Ophardt et al. |
| 8,387,830 | B2 | 3/2013 | Proper et al. |
| 8,397,949 | B2 | 3/2013 | Ophardt |
| 8,398,041 | B2 | 3/2013 | Brinkdopke et al. |
| 8,400,310 | B2 | 3/2013 | Brow |
| 8,413,849 | B2 | 4/2013 | Flores |
| 8,433,535 | B2 | 4/2013 | Studer |
| 8,479,951 | B2 | 7/2013 | Ciavarella et al. |
| 8,479,956 | B2 | 7/2013 | Lewis, II et al. |
| 8,496,142 | B2 | 7/2013 | Uehira et al. |
| 8,499,981 | B2 | 8/2013 | Quinlan et al. |
| 8,528,787 | B2 | 9/2013 | Cittadino et al. |
| 8,555,934 | B2 | 10/2013 | Allef |
| 8,561,441 | B2 | 10/2013 | Herrmann et al. |
| 8,561,847 | B2 | 10/2013 | Rosenkranz et al. |
| 8,573,715 | B1 | 11/2013 | Jackman |
| 8,590,751 | B2 | 11/2013 | Ciavarella et al. |
| 8,622,242 | B2 | 1/2014 | Pelfrey |
| 8,640,934 | B2 | 2/2014 | Jamieson et al. |
| 8,651,328 | B2 | 2/2014 | Cittadino |
| 8,657,160 | B2 | 2/2014 | Lashells et al. |
| 8,668,116 | B2 | 3/2014 | Ciavarella et al. |
| 8,672,183 | B2 | 3/2014 | Ophardt et al. |
| 8,672,187 | B2 | 3/2014 | Ophardt |
| 8,677,528 | B2 | 3/2014 | Hookway et al. |
| 8,684,228 | B2 | 4/2014 | Parker |
| 8,684,236 | B2 | 4/2014 | Ophardt |
| 8,689,820 | B2 | 4/2014 | Kissel |
| 8,695,856 | B2 | 4/2014 | Nilsson |
| 8,701,942 | B2 | 4/2014 | Nilsson |
| 8,708,200 | B2 | 4/2014 | Nilsson |
| 8,727,167 | B2 | 5/2014 | Soh |
| 8,733,596 | B2 | 5/2014 | Ophardt et al. |
| 8,746,510 | B2 | 6/2014 | Cittadino et al. |
| 8,783,510 | B2 | 7/2014 | Reynolds |
| 8,783,511 | B2 | 7/2014 | Snodgrass |
| 8,783,513 | B2 | 7/2014 | Beavis et al. |
| 8,783,520 | B2 | 7/2014 | Hagleitner |
| 8,807,398 | B2 | 8/2014 | Sundberg et al. |
| 8,814,005 | B2 | 8/2014 | Banks et al. |
| 8,820,585 | B1 | 9/2014 | Banks et al. |
| 8,844,769 | B2 | 9/2014 | Rosenkranz et al. |
| 8,851,331 | B2 | 10/2014 | Pelkey et al. |
| 8,870,306 | B2 | 10/2014 | Simon |
| 8,875,943 | B2 | 11/2014 | Benedetti |
| 8,893,928 | B2 | 11/2014 | Proper |
| 8,915,358 | B2 | 12/2014 | Johnson et al. |
| 8,931,971 | B2 | 1/2015 | Schwarz et al. |
| 8,955,718 | B2 | 2/2015 | Ciavarella et al. |
| 8,963,721 | B2 | 2/2015 | Harris et al. |
| 8,991,657 | B2 | 3/2015 | Ciavarella et al. |
| 9,010,602 | B2 | 4/2015 | Budz et al. |
| 9,027,788 | B2 | 5/2015 | Ophardt et al. |
| 9,027,790 | B2 | 5/2015 | Ciavarella et al. |
| 9,038,862 | B2 | 5/2015 | McNulty et al. |
| 9,065,263 | B2 | 6/2015 | Porcano |
| 9,073,066 | B2 | 7/2015 | Banks et al. |
| 9,089,226 | B2 | 7/2015 | Kling |
| 9,089,860 | B2 | 7/2015 | Quinlan et al. |
| 9,105,203 | B2 | 8/2015 | Carlson et al. |
| 9,149,161 | B2 | 10/2015 | Ophardt et al. |
| 9,161,621 | B1 | 10/2015 | Huffin |
| 9,172,266 | B2 | 10/2015 | Curtis et al. |
| 9,179,808 | B2 | 11/2015 | McNulty et al. |
| 9,198,546 | B1 | 12/2015 | Brown |
| 9,204,765 | B2 | 12/2015 | McNulty et al. |
| 9,220,379 | B2 | 12/2015 | Winestock et al. |
| 9,271,611 | B2 | 3/2016 | Stratmann |
| 9,302,285 | B2 | 4/2016 | Marbet et al. |
| 9,307,871 | B2 | 4/2016 | McNulty et al. |
| 9,340,337 | B2 | 5/2016 | Pelkey et al. |
| 9,357,886 | B2 | 6/2016 | Duncan |
| 9,357,888 | B2 | 6/2016 | Wegelin et al. |
| 9,394,637 | B2 | 7/2016 | Knowlson et al. |
| 9,408,502 | B2 | 8/2016 | Pelkey |
| 9,408,505 | B2 | 8/2016 | Granger |
| 9,427,119 | B2 | 8/2016 | Crabill |
| 9,433,331 | B2 | 9/2016 | Siebel |
| 9,456,717 | B2 | 10/2016 | Kullman |
| 9,462,917 | B2 | 10/2016 | Licari |
| 9,522,773 | B2 | 12/2016 | Tom et al. |
| 9,526,382 | B2 | 12/2016 | Granger |
| 9,539,598 | B2 | 1/2017 | Ciavarella et al. |
| 9,555,429 | B2 | 1/2017 | Wegelin |
| 9,561,681 | B2 | 2/2017 | Magley |
| 9,585,528 | B2 | 3/2017 | Khamphilapanyo et al. |
| 9,586,728 | B2 | 3/2017 | Kling |
| 9,611,839 | B2 | 4/2017 | McNulty et al. |
| 9,616,445 | B2 | 4/2017 | Ciavarella et al. |
| 9,652,925 | B1 | 5/2017 | Skiffington |
| 9,675,206 | B2 | 6/2017 | Minard |
| 9,682,390 | B2 | 6/2017 | Ophardt et al. |
| 9,700,181 | B1 | 7/2017 | Santoro et al. |
| 9,706,886 | B2 | 7/2017 | Pierson |
| 9,750,377 | B2 | 9/2017 | Bai |
| 9,770,141 | B2 | 9/2017 | Wegelin et al. |
| 9,854,947 | B2 | 1/2018 | McNulty et al. |
| 9,861,237 | B2 | 1/2018 | Bredahl |
| 9,901,221 | B2 | 2/2018 | Larsson et al. |
| 9,905,114 | B2 | 2/2018 | Weiner |
| 9,920,553 | B2 | 3/2018 | Limbert et al. |
| 9,922,534 | B2 | 3/2018 | Gaisser et al. |
| 9,936,841 | B2 | 4/2018 | Ophardt et al. |
| 9,968,228 | B2 | 5/2018 | Sellars et al. |
| 9,984,553 | B2 | 5/2018 | Wegelin et al. |
| 9,986,876 | B2 | 6/2018 | Brickl et al. |
| 9,993,119 | B2 | 6/2018 | Ophardt et al. |
| 10,019,647 | B2 | 7/2018 | Jeunen |
| 10,022,741 | B2 | 7/2018 | Fuller et al. |
| 10,034,583 | B2 | 7/2018 | Carignan et al. |
| 10,034,585 | B2 | 7/2018 | Moore et al. |
| 10,066,379 | B2 | 9/2018 | Schomburg et al. |
| 10,079,502 | B2 | 9/2018 | Zosimadis et al. |
| 10,100,501 | B2 | 10/2018 | Figurski et al. |
| 10,123,661 | B2 | 11/2018 | Wertheim et al. |
| 10,130,221 | B2 | 11/2018 | Borke |
| 10,136,768 | B2 | 11/2018 | Arlemark et al. |
| 10,136,781 | B2 | 11/2018 | Li et al. |
| 10,143,340 | B2 | 12/2018 | Allard et al. |
| 10,144,020 | B2 | 12/2018 | Ophardt et al. |
| 10,149,575 | B2 | 12/2018 | Tojek et al. |
| 10,149,578 | B2 | 12/2018 | Kreuter |
| 10,159,390 | B2 | 12/2018 | Wilcox |
| 10,182,686 | B2 | 1/2019 | Chen |
| 10,188,241 | B2 | 1/2019 | Santoro et al. |
| 10,201,255 | B2 | 2/2019 | Brants |
| 10,213,063 | B2 | 2/2019 | Wegelin et al. |
| 10,214,270 | B1 | 2/2019 | Berche et al. |
| 10,219,656 | B2 | 3/2019 | Pelfrey et al. |

(56) References Cited

U.S. PATENT DOCUMENTS

| | | | |
|---|---|---|---|
| 10,242,301 | B2 | 3/2019 | Ophardt et al. |
| 10,246,225 | B2 | 4/2019 | Metivier et al. |
| 10,251,518 | B2 | 4/2019 | Rospierski |
| 10,292,543 | B2 | 5/2019 | Ruiz et al. |
| 10,313,458 | B2 | 6/2019 | Gagnon et al. |
| 10,314,444 | B2 | 6/2019 | Boeltl |
| 10,321,792 | B2 | 6/2019 | Kennedy |
| 10,335,000 | B2 | 7/2019 | Lim |
| 10,358,335 | B2 | 7/2019 | Proper et al. |
| 10,362,853 | B2 | 7/2019 | Seidler |
| 10,365,139 | B2 | 7/2019 | Singh et al. |
| 10,420,444 | B2 | 9/2019 | Borke |
| 10,450,732 | B2 | 10/2019 | Xia |
| 10,485,385 | B2 | 11/2019 | Tojek et al. |
| 10,485,389 | B2 | 11/2019 | Cahalan et al. |
| 10,486,951 | B2 | 11/2019 | High et al. |
| 10,638,870 | B2 | 5/2020 | Studor et al. |
| 10,638,892 | B2 | 5/2020 | Bois et al. |
| 10,660,983 | B2 | 5/2020 | Jennings |
| 10,667,654 | B2 | 6/2020 | Schultz et al. |
| 10,671,902 | B2 | 6/2020 | Ophardt et al. |
| 10,758,095 | B2 | 9/2020 | Kling |
| 10,765,620 | B2 | 9/2020 | Fedyna |
| 10,893,781 | B2 | 1/2021 | Farahat et al. |
| 11,744,413 | B2 * | 9/2023 | Lang ..... E05B 63/0056 222/181.1 |
| 2002/0079367 | A1 | 6/2002 | Montani |
| 2003/0019031 | A1 | 1/2003 | Mosis |
| 2003/0033669 | A1 | 2/2003 | Fernie |
| 2003/0204642 | A1 | 10/2003 | Sanders et al. |
| 2004/0041021 | A1 | 3/2004 | Nugent |
| 2004/0141797 | A1 | 7/2004 | Garabedian et al. |
| 2005/0072808 | A1 | 4/2005 | Kitamura |
| 2005/0127099 | A1 | 6/2005 | Chou |
| 2005/0156080 | A1 | 7/2005 | Lugo |
| 2006/0000844 | A1 | 1/2006 | Makiej |
| 2006/0124811 | A1 | 6/2006 | Tatarsky et al. |
| 2006/0168746 | A1 | 8/2006 | Guyuron et al. |
| 2006/0208130 | A1 | 9/2006 | Castor et al. |
| 2006/0213929 | A1 | 9/2006 | Ophardt et al. |
| 2007/0000941 | A1 | 1/2007 | Hadden et al. |
| 2007/0007306 | A1 | 1/2007 | Lin |
| 2007/0029343 | A1 | 2/2007 | Sanfilippo et al. |
| 2007/0067934 | A1 | 3/2007 | Osborne |
| 2007/0157376 | A1 | 7/2007 | Paz et al. |
| 2007/0213877 | A1 | 9/2007 | Hart et al. |
| 2007/0257058 | A1 | 11/2007 | Ophardt et al. |
| 2007/0264167 | A1 | 11/2007 | Warner |
| 2007/0290094 | A1 | 12/2007 | Anderson |
| 2008/0145826 | A1 | 6/2008 | Cohen et al. |
| 2008/0238275 | A1 | 10/2008 | Andersson et al. |
| 2008/0276395 | A1 | 11/2008 | Powell et al. |
| 2009/0045221 | A1 | 2/2009 | Ophardt et al. |
| 2009/0087534 | A1 | 4/2009 | Mclemore |
| 2009/0090737 | A1 | 4/2009 | Franco |
| 2009/0145801 | A1 | 6/2009 | Moon |
| 2009/0184137 | A1 | 7/2009 | OBrien |
| 2009/0200331 | A1 | 8/2009 | Bunoz et al. |
| 2009/0302067 | A1 | 12/2009 | Hendrickx et al. |
| 2010/0012679 | A1 | 1/2010 | Brownlee |
| 2010/0117495 | A1 | 5/2010 | Cornell |
| 2010/0206909 | A1 | 8/2010 | O'Brien |
| 2010/0219199 | A1 | 9/2010 | Andochick |
| 2010/0237096 | A1 | 9/2010 | Wegelin |
| 2010/0252568 | A1 | 10/2010 | Ciavarella |
| 2010/0301070 | A1 | 12/2010 | Allef et al. |
| 2010/0308076 | A1 | 12/2010 | Snodgrass |
| 2011/0011890 | A1 | 1/2011 | Rosenkranz et al. |
| 2011/0017778 | A1 | 1/2011 | Kadiks et al. |
| 2011/0047876 | A1 | 3/2011 | Houser et al. |
| 2011/0056987 | A1 | 3/2011 | Proper et al. |
| 2012/0006848 | A1 | 1/2012 | Reynolds |
| 2012/0080452 | A1 | 4/2012 | Boshuizen |
| 2012/0111890 | A1 | 5/2012 | Herring et al. |
| 2012/0181405 | A1 | 7/2012 | Zlatic et al. |
| 2012/0199609 | A1 | 8/2012 | Schwenkenberg |
| 2012/0205325 | A1 | 8/2012 | Richter et al. |
| 2012/0260831 | A1 | 10/2012 | Mccarty |
| 2012/0267387 | A1 | 10/2012 | Omdoll et al. |
| 2013/0033376 | A1 | 2/2013 | Seyed Momen et al. |
| 2013/0087579 | A1 | 4/2013 | Knighton |
| 2013/0101332 | A1 | 4/2013 | Arkwright |
| 2013/0240660 | A1 | 9/2013 | Greer et al. |
| 2013/0306677 | A1 | 11/2013 | Rosenkranz et al. |
| 2014/0014675 | A1 | 1/2014 | Ingvarsson et al. |
| 2014/0034664 | A1 | 2/2014 | Biro |
| 2014/0061230 | A1 | 3/2014 | Jonsson |
| 2014/0102008 | A1 | 4/2014 | Mastrosimone-Gese |
| 2014/0103133 | A1 | 4/2014 | Muderlak et al. |
| 2014/0203133 | A1 | 7/2014 | Andersson et al. |
| 2014/0230960 | A1 | 8/2014 | Ciavarella et al. |
| 2014/0231451 | A1 | 8/2014 | Hammond et al. |
| 2014/0261710 | A1 | 9/2014 | Gallob |
| 2014/0367401 | A1 | 12/2014 | Stralin et al. |
| 2015/0001238 | A1 | 1/2015 | Franklin |
| 2015/0028054 | A1 | 1/2015 | Norman |
| 2015/0053813 | A1 | 2/2015 | Happs |
| 2015/0083754 | A1 | 3/2015 | Proper et al. |
| 2015/0199883 | A1 | 7/2015 | Hartley et al. |
| 2016/0029856 | A1 | 2/2016 | Orefice |
| 2016/0120378 | A1 | 5/2016 | Matthews |
| 2016/0150921 | A1 | 6/2016 | Shea |
| 2016/0174703 | A1 | 6/2016 | Groenke |
| 2016/0174779 | A1 | 6/2016 | Yaros |
| 2016/0235258 | A1 | 8/2016 | Zhao |
| 2016/0296082 | A1 | 10/2016 | Hicks |
| 2016/0296083 | A1 | 10/2016 | Reilly et al. |
| 2016/0302628 | A1 | 10/2016 | Larsson et al. |
| 2016/0316983 | A1 | 11/2016 | Call |
| 2016/0324375 | A1 | 11/2016 | Martorelli, II |
| 2016/0367087 | A1 | 12/2016 | Li |
| 2017/0046904 | A1 | 2/2017 | Studor |
| 2017/0055781 | A1 | 3/2017 | Hinson |
| 2017/0074388 | A1 | 3/2017 | Cittadino et al. |
| 2017/0181570 | A1 | 6/2017 | Hackney |
| 2017/0202410 | A1 | 7/2017 | Epperley |
| 2017/0251890 | A1 | 9/2017 | Groover |
| 2017/0332851 | A1 | 11/2017 | Barrios et al. |
| 2017/0354299 | A1 | 12/2017 | Scholer |
| 2018/0008103 | A1 | 1/2018 | Berke |
| 2018/0009565 | A1 | 1/2018 | Carlson et al. |
| 2018/0038089 | A1 | 2/2018 | Caldwell et al. |
| 2018/0070780 | A1 | 3/2018 | Rodriguez |
| 2018/0140143 | A1 | 5/2018 | Lien et al. |
| 2018/0146830 | A9 | 5/2018 | Yocom et al. |
| 2018/0177348 | A1 | 6/2018 | Swanson et al. |
| 2018/0206684 | A1 | 7/2018 | Tedesco et al. |
| 2019/0156652 | A1 | 5/2019 | Berland |
| 2019/0231148 | A1 | 8/2019 | Banks et al. |
| 2019/0299228 | A1 | 10/2019 | Ophardt et al. |
| 2019/0330891 | A1 | 10/2019 | Pare |
| 2020/0163496 | A1 | 5/2020 | Tojek et al. |
| 2020/0292366 | A1 | 9/2020 | Ophardt et al. |
| 2020/0337506 | A1 | 10/2020 | Marshall |

FOREIGN PATENT DOCUMENTS

| | | | |
|---|---|---|---|
| CA | 2125160 | C | 3/1993 |
| CA | 2229982 | A1 | 3/1999 |
| CA | 2574783 | C | 12/1999 |
| CA | 2354113 | A1 | 2/2002 |
| CA | 2363744 | C | 5/2003 |
| CA | 2471837 | C | 12/2005 |
| CA | 2757878 | A1 | 5/2012 |
| CA | 2857325 | A1 | 1/2016 |
| CA | 2887743 | A1 | 10/2016 |
| CN | 201518964 | U | 7/2010 |
| CN | 105769027 | A | 7/2016 |
| DE | 20318465 | U1 | 5/2005 |
| EP | 0122809 | A1 | 10/1984 |
| EP | 0101287 | A3 | 12/1984 |
| EP | 0176135 | A2 | 4/1986 |
| EP | 1044643 | A1 | 10/2000 |
| EP | 1098276 | A2 | 5/2001 |

(56) References Cited

FOREIGN PATENT DOCUMENTS

| | | | |
|---|---|---|---|
| EP | 1345519 | A1 | 9/2003 |
| EP | 1577375 | A3 | 5/2006 |
| EP | 1444049 | B1 | 8/2007 |
| EP | 1217931 | B1 | 11/2007 |
| EP | 1280448 | B1 | 2/2008 |
| EP | 1677655 | B1 | 9/2008 |
| EP | 1706011 | B1 | 12/2008 |
| EP | 1454576 | B1 | 6/2009 |
| EP | 2068689 | A1 | 6/2009 |
| EP | 1702547 | B1 | 8/2009 |
| EP | 0984715 | B2 | 1/2010 |
| EP | 1938726 | B1 | 9/2010 |
| EP | 2408344 | A2 | 1/2012 |
| EP | 2441365 | A1 | 4/2012 |
| EP | 2550907 | A1 | 1/2013 |
| EP | 2370327 | B1 | 4/2013 |
| EP | 2370045 | B1 | 1/2014 |
| EP | 2328690 | B1 | 1/2015 |
| EP | 2299885 | B1 | 7/2015 |
| EP | 2234896 | B1 | 8/2015 |
| EP | 2376346 | B3 | 1/2016 |
| EP | 2669214 | B1 | 1/2016 |
| EP | 2669215 | B1 | 1/2016 |
| EP | 2283194 | B1 | 2/2016 |
| EP | 2723267 | B1 | 3/2016 |
| EP | 2322068 | B1 | 4/2016 |
| EP | 2277423 | B1 | 5/2016 |
| EP | 2729701 | B1 | 8/2016 |
| EP | 2855029 | B1 | 12/2016 |
| EP | 2893073 | B1 | 2/2017 |
| EP | 2908956 | B1 | 5/2017 |
| EP | 2987440 | B1 | 10/2017 |
| EP | 3243414 | A1 | 11/2017 |
| EP | 2566377 | B1 | 1/2018 |
| EP | 2896340 | B1 | 5/2018 |
| EP | 3359006 | A1 | 8/2018 |
| EP | 2502677 | B1 | 12/2018 |
| EP | 2914384 | B1 | 1/2019 |
| EP | 2948255 | B1 | 1/2019 |
| EP | 2888056 | B1 | 2/2019 |
| EP | 2846925 | B1 | 3/2019 |
| EP | 2669016 | B1 | 4/2019 |
| EP | 2844118 | B1 | 4/2019 |
| EP | 2967262 | B1 | 4/2019 |
| EP | 3245924 | B1 | 4/2019 |
| EP | 3331409 | B1 | 7/2019 |
| EP | 2223642 | B1 | 9/2019 |
| EP | 3533368 | A1 | 9/2019 |
| EP | 3556472 | A1 | 10/2019 |
| EP | 2520910 | B1 | 12/2019 |
| EP | 3376926 | B1 | 7/2020 |
| EP | 3488937 | B1 | 7/2020 |
| EP | 3370590 | B1 | 9/2020 |
| EP | 3711645 | A1 | 9/2020 |
| EP | 3448215 | B1 | 11/2020 |
| EP | 3520662 | B1 | 11/2020 |
| EP | 3738491 | A1 | 11/2020 |
| EP | 3738492 | A1 | 11/2020 |
| EP | 2665403 | B1 | 9/2021 |
| EP | 3402378 | B1 | 10/2021 |
| EP | 3244782 | B1 | 12/2021 |
| FR | 2869305 | B1 | 9/2014 |
| GB | 714590 | A | 9/1954 |
| GB | 808721 | A | 2/1959 |
| GB | 1019718 | A | 2/1966 |
| GB | 1119690 | A | 7/1968 |
| GB | 1352283 | A | 5/1974 |
| GB | 1395162 | A | 5/1975 |
| GB | 1430153 | A | 3/1976 |
| GB | 2298851 | B | 2/1997 |
| GB | 2460761 | A | 12/2009 |
| GB | 2469482 | A | 10/2010 |
| GB | 2484571 | A | 4/2012 |
| GB | 2495788 | A | 4/2013 |
| GB | 2500282 | A | 9/2013 |
| GB | 2544828 | B | 2/2018 |
| JP | 2003003670 | A | 1/2003 |
| JP | 3100367 | U | 5/2004 |
| KR | 1020010071448 | A | 7/2001 |
| KR | 1020030009198 | A | 1/2003 |
| KR | 200490815 | Y1 | 1/2020 |
| TW | I502126 | B | 10/2015 |
| WO | 1992009230 | A1 | 6/1992 |
| WO | 1994020407 | A1 | 9/1994 |
| WO | 1995034503 | A1 | 12/1995 |
| WO | 02/049490 | A1 | 6/2002 |
| WO | 2003013674 | A1 | 2/2003 |
| WO | 2006006058 | A2 | 1/2006 |
| WO | 2007148125 | A2 | 12/2007 |
| WO | 2008006209 | A2 | 1/2008 |
| WO | 2008024005 | A2 | 2/2008 |
| WO | 2008041939 | A1 | 4/2008 |
| WO | 2008092196 | A1 | 8/2008 |
| WO | 2011031144 | A3 | 6/2011 |
| WO | 2011077111 | A1 | 6/2011 |
| WO | 2013165994 | A1 | 11/2013 |
| WO | 2016042315 | A1 | 3/2016 |
| WO | 2016075705 | A3 | 8/2016 |
| WO | 2017033004 | A1 | 3/2017 |
| WO | 2017050390 | A1 | 3/2017 |
| WO | 2017050392 | A1 | 3/2017 |
| WO | 2017050394 | A1 | 3/2017 |
| WO | 2017062325 | A1 | 4/2017 |
| WO | 2017077269 | A1 | 5/2017 |
| WO | 2017085320 | A1 | 5/2017 |
| WO | 2017089840 | A1 | 6/2017 |
| WO | 2017213673 | A1 | 12/2017 |
| WO | 2018014844 | A1 | 1/2018 |
| WO | 2018069762 | A1 | 4/2018 |

OTHER PUBLICATIONS

International Search Report and Written Opinion in International Application No. PCT/IB2022/059557, mailed Mar. 4, 2023 (17 pages).

* cited by examiner

DISPENSER ASSEMBLY

CROSS-REFERENCE TO RELATED APPLICATIONS

This application is a continuation of U.S. application Ser. No. 17/496,173, filed on Oct. 7, 2021, which is incorporated herein by reference in its entirety.

BACKGROUND

Field of the Disclosure

The present disclosure relates to a dispenser assembly that utilizes a release device for a dispenser.

Description of the Background of the Disclosure

Dispensers are used in a wide variety of different environments, ranging from public bathrooms to offices, restaurants, and other public or private establishments.

Depending on the location of the dispenser, the considerations which go into choosing a given dispenser tend to vary. For example, in some locations, the primary consideration when choosing a dispenser may be ease of use, to enable maintenance staff to swiftly and efficiently refill the dispenser. However, in other locations, the primary consideration may be to provide a secure and tamper-proof dispenser to prevent stock from being accessed and removed by unauthorized personnel. For manufacturers, it is beneficial to provide a single dispenser unit that can be adapted to meet such requirements.

An example of a known release mechanism for a dispenser is described in U.S. Pat. No. 8,528,787, which discloses a cover that is movably coupled to a back-housing and secured with removable, mutually interchangeable inserts, including a key insert and a button insert. However, as will be appreciated, interchanging the various inserts of the dispenser in U.S. Pat. No. 8,528,787 can be time-consuming and renders them prone to becoming lost or discarded.

It is therefore the aim of the present disclosure to address or mitigate at least some of the issues encountered with known dispensers.

SUMMARY

In one aspect, a dispenser includes a front panel and a body coupled to the front panel to form an interior cavity. The body includes a top portion and an opening is formed through the top portion. A housing includes a first housing wall and a second housing wall that each extend from the top portion adjacent the opening and into the interior cavity. The first and second housing walls include first and second rails, respectively, which are coplanar and extend from the respective first and second housing walls in opposing directions relative to each other.

In some embodiments, a rear housing wall extends between the first and second housing walls and the rear housing wall is spaced apart from the first and second rails. In some aspects, the rear housing wall includes a pair of channels and a pair of apertures. The pair of channels can be located closer to the top portion of the body than the pair of apertures. In some embodiments, the pair of channels extend a first distance along the rear housing wall, the pair of apertures extend a second distance along the rear housing wall, and the first distance is greater than the second distance. In some aspects, a vertical axis extends centrally through the aperture and coaxially with a passage formed through the housing. The passage can extend from the opening to an open bottom end of the housing and into the interior cavity of the dispenser. In some embodiments, a plurality of apertures are arranged on the housing and include a first set that is spaced apart from a second set. The first and second set can be located equidistant from the vertical axis. Further, a hinge defines a hinge axis about which the front panel rotates relative to the body and the housing is located at an end of the dispenser that is opposite the hinge axis. In some embodiments, the opening includes a front edge and a rear edge, and a projection extends from the top portion into the interior cavity at a location adjacent to the front edge. In addition, the projection is spaced approximately centrally from the first and second rails.

In another aspect, a device includes a first wall connected to a first end of a pair of side walls and a second wall connected to a second end of the pair of side walls. The first wall and the second wall each define a rectangular perimeter, and the second wall defines a receptacle extending therethrough to a chamber formed between the first end and the second end.

In some embodiments, a pair of hooks includes a first hook and a second hook that is coplanar with the first hook and the first hook extends from one of the pair of side walls in a direction opposite to the second hook. Further, the first hook and the second hook are each disposed adjacent to an opening that is defined between the first wall and the second wall and communicates with the chamber. In some aspects, the pair of hooks are located substantially centrally between the first end and the second end.

In some embodiments, a plurality of projections extend from a third end that is located adjacent the first end and the second end. The plurality of projections includes a first projection that is located substantially centrally between the first end and the second end. Further, the plurality of projections includes a second projection and a third projection, and the first projection that is located substantially centrally between the second and third projections. In some aspects, the plurality of projections is configured to form a triangular formation that is offset toward the first end. In some embodiments, a stop member is disposed within the chamber and located coaxially with the receptacle, and the stop member is spaced apart from the receptacle.

In still another aspect, a dispenser includes a front panel having a locking tongue, a body coupled to the front panel to form an interior cavity, and a release device. The body includes a wall portion extending from a back portion. An opening is formed through the wall portion at a location spaced apart from the back portion. In addition, a housing includes a first housing member and a second housing member that each extend from the wall portion adjacent the opening and into the interior cavity. Further, the release device is configured to be received within the housing in a first orientation or a second orientation, and the release device is configured to translate within the housing in the first orientation.

In some embodiments, the release device is configured to remain stationary within the housing in the second orientation. In some aspects, the locking tongue is configured to be moved by the release device translating within the housing in the first orientation, and the locking tongue is configured to be moved relative to the release device within the housing in the second orientation.

In some embodiments, the first and second housing walls include first and second rails, respectively. In some aspects, the first and second housing members include first and second rails, respectively, the first and second rails being coplanar and extending from the respective first and second housing members in opposing directions relative to each other. Further, the release device includes a first hook and a second hook that is coplanar with the first hook. The first hook extends in a direction opposite to the second hook, and the first hook and the second hook are configured to engage the first rail and the second rail, respectively, in the first orientation. In addition, the first hook and the second hook are configured to engage the second rail and the first rail, respectively, in the second orientation. In some embodiments, a post is configured to translate within a channel of the housing in the first orientation, wherein the post is configured to snap-fit into an aperture of the housing in the second orientation.

In one aspect, a dispenser assembly is provided comprising a dispenser and a release device, the dispenser comprising a body that at least partially defines an interior of the dispenser. Further, the body includes a first body portion and a second body portion moveable relative to one another between an open configuration, in which the interior is exposed, and a closed configuration, in which the interior is concealed. A locking mechanism is configured to releasably secure the first body portion and the second body portion in the closed configuration, such that when the locking mechanism is released, movement to the open configuration is permitted. In addition, a housing is configured to receive the release device. In some embodiments, the release device includes a first release feature that is configured to enable release of the locking mechanism in a first manner, and a second release feature that is configured to enable release of the locking mechanism in a second manner that is different from the first manner.

In some aspects, the dispenser is configured such that the release device is receivable in the housing in a first configuration, in which the first release feature is presented to a user such that release of the locking mechanism is enabled via the first release feature. Further, the release device is receivable in the housing in a second configuration, in which the second release feature is presented to a user such that release of the locking mechanism is enabled via the second release feature. The first and second release features provide a release device for a dispenser having interchangeable release capabilities, while also providing a reduced part count when compared to known interchangeable dispenser types. This provides a dispenser which can be quickly and easily adapted depending on the requirements of the user. In some embodiments, the release device is provided as a single, unitary component. In this way, a number of parts is reduced to result in efficient manufacture, fewer parts for sale and/or assembly, and fewer parts to store and/or implement.

The term "single unitary component" is used herein to refer to both a component which has been integrally formed as a single component or a component made up of multiple sub-components, which have been joined or bonded together to form a single component. In some embodiments, the release device may be integrally formed as a single unitary component.

In some embodiments, the first configuration may comprise a first orientation of the release device with respect to the dispenser. In some embodiments, the second configuration may comprise a second orientation of the release device with respect to the dispenser. In this way, the release device is easily adapted between configurations by reorienting the device. In some embodiments, the release device is removable from the dispenser. In some embodiments, the release device is replaceable in the dispenser. In this way, the release device is easily adapted between configurations by removing the release device from the dispenser and re-inserting the release device into the dispenser in the desired configuration.

In some embodiments, the release device is configured to be moveable from the first configuration to the second configuration. In some embodiments, the release device is configured such that, the second orientation is upside down with respect to the first orientation. In some embodiments, the first and second release features may be located on different surfaces of the release device. In some embodiments, the first release feature may be located diametrically opposite to the second release feature. In some embodiments, the release device may be substantially symmetrical.

In some embodiments, the first manner includes releasing the locking mechanism. In some embodiments, the first manner involves exerting a force on the release device to cause translation of the release device within the housing of the dispenser. In some embodiments, the first release feature includes a surface for actuation by a user, actuation of which enables release of the locking mechanism. In some embodiments, the first release feature includes a surface for actuation by a user, such that the release device can be configured to act as a push button for releasing the locking mechanism. In this way, the release device affords quick and easy operation for maintenance professionals, or other such personnel, when desired.

In some embodiments, the release device is configured to be translated along a translation axis. In some embodiments, the release device is substantially symmetrical about the translation axis. In some embodiments, the release device includes a first engaging element that is configured to interact with a first corresponding element of the housing such that, when the release device is in the first configuration, the first engaging element and the first corresponding element of the housing are configured to interact with each other so as to permit translation of the release device within the housing. In some embodiments, translation of the release device is permitted through a predetermined distance. In this way, the release device is prevented from becoming excessively translated during use, where it may become stuck, damaged, or may cause damage to other components of the dispenser, therefore promoting continued, repeated use over an extended lifecycle.

In some embodiments, the second release feature includes a tool receptacle that is configured to receive a corresponding tool to enable release of the locking mechanism. In some embodiments, the tool receptacle is a key slot. In some embodiments, the corresponding tool may be a key. In some embodiments, the tool receptacle is provided in the form of an open ring. Alternatively, the tool receptacle is differently shaped. In this way, the release device and the tool afford improved security in circumstances where secure access is required, for example to prevent theft or contamination of a cartridge or fluid product that is dispensed by the dispenser.

In some embodiments, the release device includes a second engaging element that is configured to interact with a second corresponding element of the housing, such that, when the release device is in the second configuration, the second engaging element and the second corresponding element are configured to interact with one another to substantially prevent movement of the release device within said dispenser. In this way, the release device prevents the dispenser from being forced open when placed in the second configuration by forcibly pressing the release device.

In some embodiments, the release device include a plurality of first and second engaging elements. In some embodiments, the first and second engaging elements are provided by the same engaging element, e.g., a single engaging element. In this way, the number of components of the release device is reduced. In some embodiments, the first and/or second engaging element includes at least one projection. In some embodiments, the at least one projection is a single projection. In some embodiments, the at least one projection is a resilient projection that is configured to form a snap-fit engagement with the dispenser.

In some embodiments, the release device includes a side, front, and/or rear wall. In some embodiments, the at least one projection is located on the front, side, and/or rear wall of the release device. In some embodiments, the housing includes a side, front, and/or rear wall, and the at least one projection is located at the side, front, and/or rear wall of the housing. In some embodiments, the first engaging element and the first corresponding element of the housing include an arrangement having a projection and a channel. In some embodiments, the projection and channel are configured such that, when the release device is in the first configuration, the projection is configured to slide along the channel causing translation of the release device in the housing. The projection and channel may interact to limit translation of the release device within the housing.

In some embodiments the first engaging element includes a projection and the first corresponding element includes a channel or vice versa. In some embodiments, the first engaging element includes a plurality of projections and the first corresponding element includes a plurality of corresponding channels. In some embodiments, the first engaging element and the first corresponding element of the housing include an arrangement comprising a plurality of projections and corresponding channels.

In some embodiments, the second engaging element of the release device and the second corresponding element of the housing include an arrangement comprising a projection and aperture. In some embodiments, the projection and aperture are configured such that, when the release device is in the second configuration, the projection and the aperture interact to substantially prevent movement of the release device within the housing.

In some embodiments, the second engaging element includes a projection and the second corresponding element includes an aperture, although other configurations are possible. In some embodiments, the second engaging element includes a plurality of projections and the second corresponding element includes a plurality of corresponding apertures. In some embodiments, the second engaging element and the second corresponding element of the housing include an arrangement having a plurality of projections and corresponding apertures.

In some embodiments, the housing includes a side, front, and/or rear wall, and the at least one channel is located at the side, front, and/or rear wall of the housing. In some embodiments, the release device includes a side, front, and/or rear wall. In some embodiments, the at least one channel is located on the front, side, and/or rear wall of the release device. In some embodiments, the housing is a side, front, and/or rear wall, and at least one aperture is located at the side, front, and/or rear wall of the housing. In some embodiments, the release device includes a side, front, and/or rear wall. In some embodiments, the at least one aperture is located on the front, side, and/or rear wall of the release device.

In some embodiments, the release device includes a guide structure that is configured to interact with the housing of the dispenser to guide movement of the release mechanism in the housing. In some embodiments, the guide structure includes at least one guide arm that is configured to interact with a corresponding feature of the dispenser. In some embodiments, the guide structure includes at least one guide hook configured to engage at least one guide track provided by the dispenser housing. In some embodiments, the guide structure includes a pair of guide arms. In some embodiments, the guide structure includes a pair of guide hooks that are configured to engage a pair of guide tracks provided by the dispenser housing. In this way, the guide structure of the release device promotes stability when the release device is received within the dispenser.

In some embodiments, the locking mechanism includes a locking tongue. In some embodiments, the first and second release features are configured to enable deflection of the locking tongue from a locked position to an unlocked position to enable release of the locking mechanism. In some embodiments, the locking tongue includes a resilient locking tongue. In some embodiments, the locking tongue is configured to deflect in a direction along the translation axis. Accordingly, the locking tongue acts as a spring to return the release device to a starting position.

In some embodiments, the release device includes a stopper that is configured to restrict deflection of the locking tongue. In this way, the stopper prevents the locking tongue of the dispenser from becoming deflected past its elastic limit, which may lead to damage. In some embodiments, the locking mechanism includes a plurality of locking mechanisms. In some embodiments, the plurality of locking mechanisms includes a plurality of locking tongues. The dispenser assembly includes one or more release devices for releasing the plurality of locking mechanisms.

In some embodiments, the first and second release features are configured to release the plurality of locking mechanisms. In some embodiments, the first release feature includes a surface for actuation by a user, such that the release device is configured to act as a push button to deflect the plurality of locking tongues to enable release of the locking mechanism. In this way, dispensers with multiple locking mechanisms are quickly and easily opened by a user via the first release feature.

In some embodiments, the release device includes a plurality of first release features and the second release feature includes a plurality of tool receptacles that are configured to enable interaction between the plurality of locking mechanisms and a corresponding tool or tools. The tool may be a single tool comprising a first projection configured for insertion into a first tool receptacle and a second projection configured for insertion into a second tool receptacle. In some embodiments, the plurality of locking mechanisms are offset from each other relative to a translation axis to further prevent tampering of the dispenser. In some embodiments, the first projection and the second projection of the tool may be of different lengths, which may enable dispensers with multiple locking mechanisms to be more easily opened by a user via the second release feature.

In some embodiments, the housing is integrally formed as part of the first body portion. In other embodiments, the housing is integrally formed as part of the second body portion. In some embodiments, the first and/or second body portion include(s) at least one reinforcing projection. In some embodiments, the second and/or first body portion include(s) at least one corresponding receiving structure that is configured to receive the reinforcing projection when the first and second body portions are in the closed configuration. In some embodiments, the at least one reinforcing projection includes a pair of reinforcing projections. In some embodiments, the at least one reinforcing projection includes four reinforcing projections. In some embodiments, the at least one reinforcing projection includes three reinforcing projections, five reinforcing projections, or greater than five reinforcing projections.

In some embodiments, the at least one corresponding receiving structure includes a pair of corresponding receiving structures. In some embodiments, the at least one corresponding receiving structure includes four of corresponding receiving structures. In some embodiments, the at least one corresponding receiving structure includes three corresponding receiving structures, five corresponding receiving structures, or greater than five corresponding receiving structures. In some embodiments, a single receiving structure is configured to receive a plurality of reinforcing projections.

In some embodiments, the dispenser assembly is configured for dispensing a fluid. In some embodiments, the dispenser assembly includes a refillable and/or replaceable cartridge that contains fluid to be dispensed. In some embodiments, the dispenser is configured to dispense soap, such as, e.g., hand soap. In some embodiments, the dispenser includes a dispensing mechanism, e.g., a pumping mechanism, to facilitate dispensing of fluid. In some embodiments, the dispenser is configured to dispense a non-fluid product, e.g., a hand towel, a toilet roll, or any other suitable product.

In some aspects, a release device is provided for a dispenser that includes a locking mechanism. Further, the release device includes a first release feature that is configured to enable release of the locking mechanism in a first manner and a second release feature that is configured to enable release of the locking mechanism in a second manner that is different from the first manner. In some embodiments, the release device is configured to be received by a dispenser in a first configuration in which the first release feature is presented to a user, such that release of the locking mechanism is enabled by the first release feature. In addition, the release device is configured to be received by a dispenser in a second configuration in which the second release feature is presented to a user, such that release of the locking mechanism is enabled by the second release feature. In some embodiments the release device is provided as a single unitary component.

In still another aspect, a dispenser includes a body that at least partially defines an interior of the dispenser. Further, the body includes a first body portion and a second body portion moveable relative to each other between an open configuration, in which the interior is exposed, and a closed configuration, in which the interior is concealed. The dispenser includes a locking mechanism that is configured to releasably secure the first body portion and the second body portion in the closed configuration, such that when the locking mechanism is released, movement to the open configuration is permitted.

In addition, a housing is configured to receive a release device and the dispenser is configured such that the release device is receivable in the housing in a first configuration to enable release of the locking mechanism in a first manner, and the release device is receivable in the housing in a second configuration to enable release of the locking mechanism in a second manner that is different from the first manner. In some embodiments, the dispenser is a hand towel dispenser, a toilet roll dispenser or any other suitable dispenser type.

In some aspects, a dispenser includes a body coupled to a front panel to form an interior cavity. The body includes a sidewall extending from a back portion. An opening is formed through the sidewall at a location spaced apart from the back portion. A housing extends from the sidewall adjacent the opening and into the interior cavity. In addition, a lock is configured to be received within the housing in a first orientation or a second orientation, the lock having a wall that is positioned within the opening in the second orientation. Further, the wall includes a receptacle formed therethrough.

In some embodiments, the lock includes a chamber that is configured to receive a latch of the front panel. In some embodiments, in the second orientation, the wall of the lock is disposed substantially flush with the sidewall. In some embodiment, the latch of the front panel is configured to be deflected by insertion of a portion of a key through the receptacle. In some embodiments, the lock includes a plurality of projections that are configured to engage a plurality of apertures of the housing, such that the lock is prevented from movement relative to the housing. In some embodiments, the lock includes a button wall that is positioned within the opening in the first orientation. In some embodiments, in the first orientation, the button wall is disposed substantially flush with the sidewall and the lock is configured to be depressed to deflect the latch. In some embodiments, the sidewall of the housing includes at least one transparent window and at least one translucent portion. In some embodiments, the lock is a unitary component.

In some aspects, a dispenser includes a body coupled to a front panel to form an interior cavity. The body includes a sidewall extending from a back portion. An opening is formed through the sidewall at a location spaced apart from the back portion. Further, a housing extends from the sidewall adjacent the opening and into the interior cavity. A lock is configured to be received within the housing in a first orientation or a second orientation, the lock having a wall that is positioned within the opening in the first orientation. A latch that is carried by the front panel is configured to be positioned within the lock in the first orientation and the second orientation.

In some embodiments, a first release feature is exposed through the opening in the first orientation and a second release feature is exposed through the opening in the second orientation. In some embodiments, the first release feature and the second release feature are configured to release the front panel from the body. In some embodiments, the first release feature is a button that is configured to be depressed into the housing. In some embodiments, the second release feature is a key receptacle that is configured to receive a key. In some embodiments, the lock is configured to be flipped over to transition between the first orientation and the second orientation.

In some aspects, a dispenser includes a body coupled to a front panel to form an interior cavity. The body includes a sidewall extending from a back portion. An opening is formed through the sidewall at a location spaced apart from the back portion, and a housing extends from the sidewall adjacent the opening and into the interior cavity. The housing has a first rail and a second rail. A lock is configured to be received within the housing in a first orientation or a second orientation, the lock having a first hook and a second hook. The first hook is configured to engage the first rail in the first orientation and the second hook is configured to engage the first rail in the second orientation.

In some embodiments, the front panel is pivotable about a hinge between a closed position and an open position, the housing being located at an end of the dispenser that is opposite the hinge. In some embodiments, the first rail and the second rail of the housing are arranged coplanar with one another and extend from the housing in opposite directions relative to one another. In some embodiments, when the lock is in the first orientation and the front panel is in the closed position, the lock is configured to be translated along the first rail and the second rail of the housing. In some embodiments, when the lock is in the second orientation and the front panel is in the closed position, the lock is configured to be prevented from translation along the first rail and the second rail of the housing.

It will be appreciated that the features described herein may apply to any aspect disclosed herein. All combinations contemplated are not recited explicitly for the sake of brevity.

BRIEF DESCRIPTION OF THE DRAWINGS

The embodiments will now be described, by way of example only and with reference to the accompanying drawings, in which.

DETAILED DESCRIPTION OF EMBODIMENTS

The present disclosure is directed to a dispenser assembly for dispensing fluid. The dispenser assembly includes a dispenser housing and a fluid cartridge. While the embodiments of the present disclosure may take many different forms, several embodiments are discussed herein with the understanding that the present disclosure is to be considered as exemplary, and it is not intended to limit the invention to the embodiments illustrated.

Further, the fluid discussed herein may comprise a soap, shampoo, hand sanitizer, lotion, cleaning agent or other desired fluid. As used herein, the term "soap" is intended to include any liquid detergent or cleaning product suitable for being dispensed from a fluid dispenser. Additives may be included in the fluid and/or soap, such as, for example, fragrances, preservatives, moisturizers, dyes, and particulates, among others.

Figure 1:
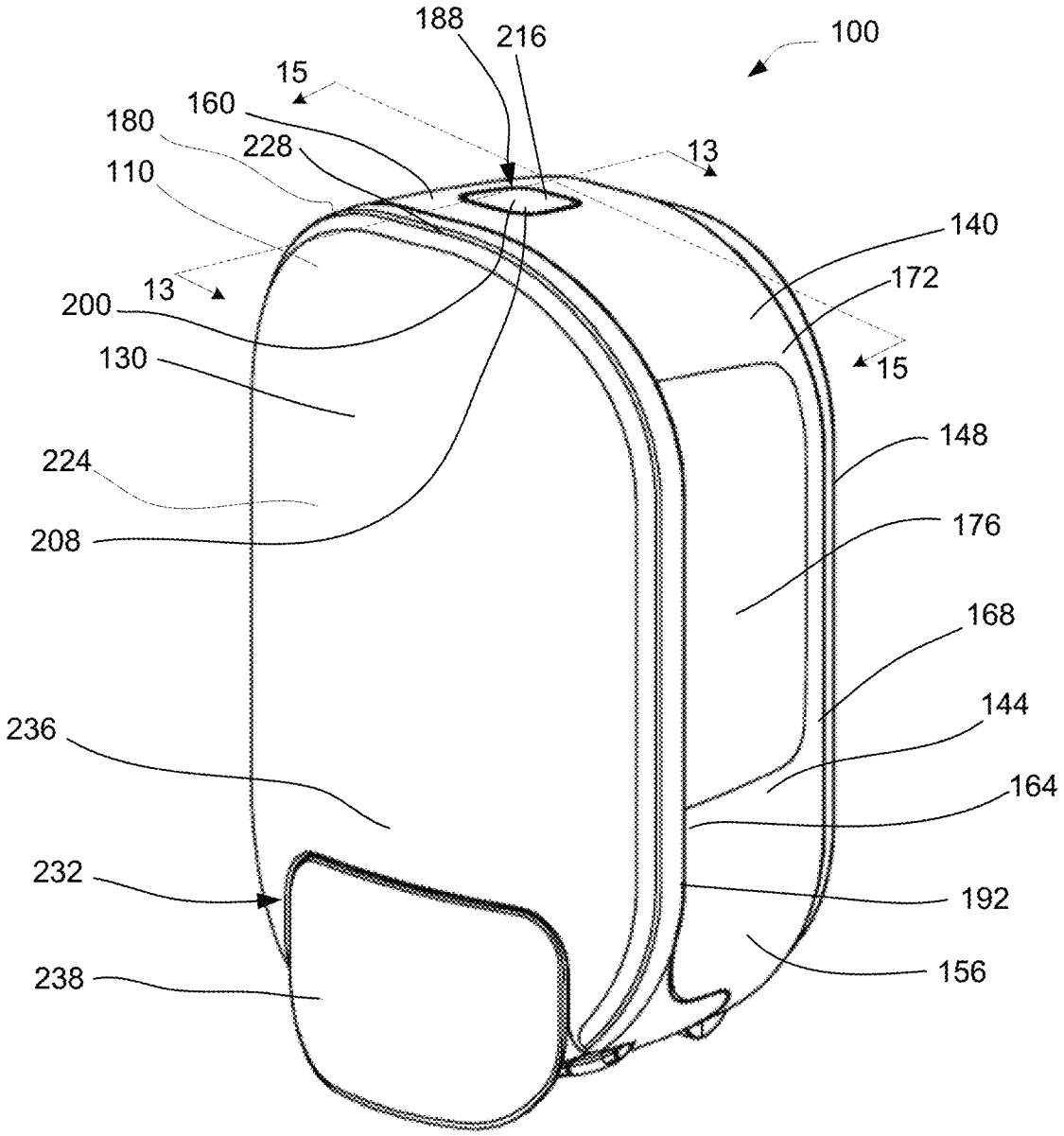
FIG. 1 illustrates a perspective view of an embodiment of a dispenser assembly when in a closed position, the dispenser assembly including a dispenser and a release device.
Figure 2:
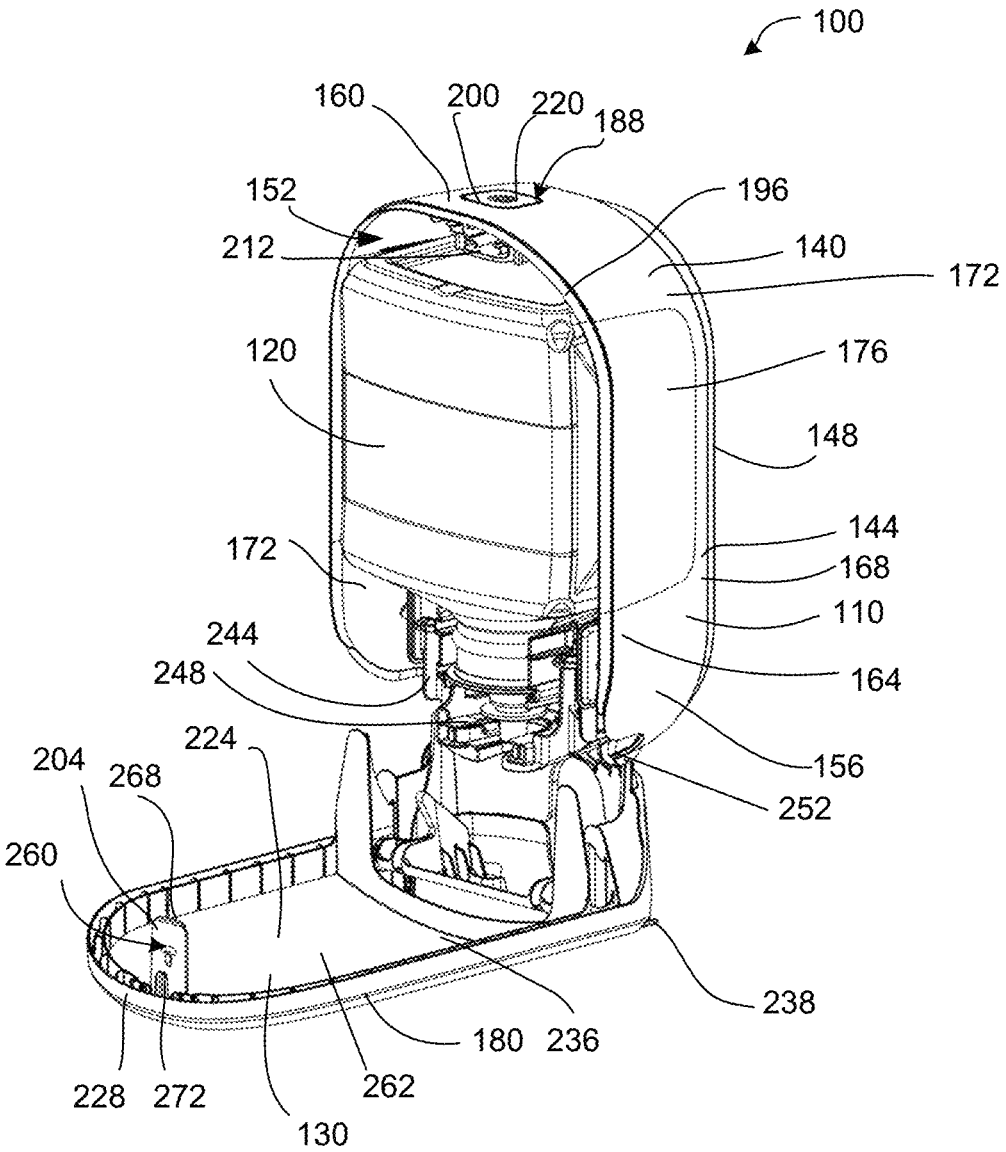
FIG. 2 illustrates a perspective view of the dispenser assembly of FIG. 1 when in an open position.

Referring to the drawings, FIGS. 1 and 2 illustrate a dispenser assembly 100 including a dispenser 110 for accommodating a refill or cartridge 120. The dispenser 110 is configured for dispensing a fluid. The fluid may comprise a soap, shampoo, hand sanitizer, lotion, cleaning agent or other desired fluid. As used herein, the term "soap" is intended to include any liquid detergent or cleaning product suitable for being dispensed from a liquid dispenser. However, it shall be appreciated that in other embodiments, the dispenser may be a hand towel dispenser, a toilet paper dispenser, a fragrance dispenser, or any other suitable dispenser type.

The dispenser 110 is configured to contain and operably engage the cartridge 120 containing fluid to be dispensed. In the embodiment shown in FIGS. 1 and 2, the cartridge 120 is a bottle type container, but other types of cartridges are included within the scope of this disclosure, such as, e.g., bags, liners, rigid and non-rigid containers, and thin-walled and thick-walled containers, among others.

As illustrated in FIGS. 1 and 2, the dispenser 110 includes a cover or front panel 130 and a body 140 that includes a wall portion(s) or sidewall 144 extending from a back wall or backplate 148 to at least partially define an interior cavity 152 of the dispenser 110. In the illustrated embodiment, the body 140 is coupled to the front panel 130 to form the interior cavity 152, although other configurations are possible. The body 140 includes a bottom end 156 that is opposite a top end 160, a front end 164 that is opposite a rear end 168, and opposing sides 172. In the illustrated embodiment, the front panel 130 is disposed at the front end 164, the backplate 148 is disposed at the rear end 168, and the sidewall 144 extends between the front end 164 and the rear end 168. In some implementations, the sidewall 144 is provided as being translucent and a pair of transparent windows 176 are arranged on the opposing sides 172, although other configurations are possible.

In one instance, the front panel 130 and the body 140 are movable relative to each other between an open position (see FIG. 2), where the interior cavity 152 is exposed and/or uncovered, and a closed position (see FIG. 1), where the interior cavity 152 of the dispenser 110 is covered and/or concealed. In the closed position, the front panel 130 includes a perimeter 180 and spans across the front end 164, from the top end 160 to the bottom end 156. Further, the sidewall 144 of the body 140 extends continuously from the top end 160 to the bottom end 156 in a generally U-shape, and an opening 188 is located at the top end 160 approximately centrally between the front and rear ends 164, 168 and between the opposing sides 172. In the illustrated embodiment, the backplate 148 and the sidewall 144 are integrally formed as a single component. However, it will be appreciated that the backplate 148 and the sidewall 144 may be provided as separate components and, further, that the sidewall 144 may be provided as multiple portions or sections coupled together.

As illustrated in FIG. 1, the front panel 130 and the body 140 mate together along at least a portion of a periphery 192 formed between the perimeter 180 of the front panel 130 and a peripheral edge 196 (see FIG. 2) of the sidewall 144, thereby causing a snug fit therebetween. In some embodiments, a gasket of elastomeric material, or any other suitable material, may be positioned between the front panel 130 and the body 140 to prevent egress or ingress of liquids, gases, sounds, or optical emissions. The gasket may be carried by the front panel 130 and/or the body 140.

As illustrated in FIGS. 1 and 2, a lock or release device 200 is disposed within the opening 188 at the top end 160 of the body 140 and a latch or locking tongue 204 is carried by the front panel 130. Together, the release device 200 and the locking tongue 204 comprise at least part of a locking mechanism 208 (see FIG. 13) that is configured to releasably secure the front panel 130 and the body 140 together in the closed position.

Referring to FIG. 2, the dispenser 110 further includes a housing 212 configured to receive the release device 200. As will be described in further detail below, the release device 200 includes a first release feature 216 that is configured to enable release of the locking mechanism 208 in a first manner (see FIGS. 1 and 8), and a second release feature 220 that is configured to enable release of the locking mechanism 208 in a second manner (see FIGS. 2 and 9), different to the first manner. In one preferred implementation, the release device 200 is provided as a single unitary component, although other configurations are possible.

With reference to FIGS. 1 and 2, the dispenser 110 is configured such that the release device 200 is receivable in the housing 212 in a first configuration (see FIG. 1), in which the first release feature 216 is exposed through the opening 188, whether the dispenser 110 is in the open position or the closed position. In this way, release of the locking mechanism 208 is enabled via the first release feature 216 to open the dispenser 110. The release device 200 is also receivable in the housing 212 in a second configuration (see FIG. 2), in which the second release feature 220 is exposed through the opening 188, whether the dispenser 110 is in the open position or the closed position. In this way, release of the locking mechanism 208 is enabled via the second release feature 220 to open the dispenser 110. Accordingly, a user, especially a maintenance professional or other authorized user of the dispenser 110, can readily identify whether the dispenser 110 is in the first configuration or the second configuration, which affords for quick, at-a-glance assessment of the dispenser 110 to save time and effort. In addition, the release device 200 consolidates the first and second release features 216, 220 into a single, unitary component, which reduces manufacturing costs, mitigates the risk of lost or misplaced parts, and affords more efficient maintenance, i.e., refill and/or cleaning, of the dispenser 110.

Figure 3:
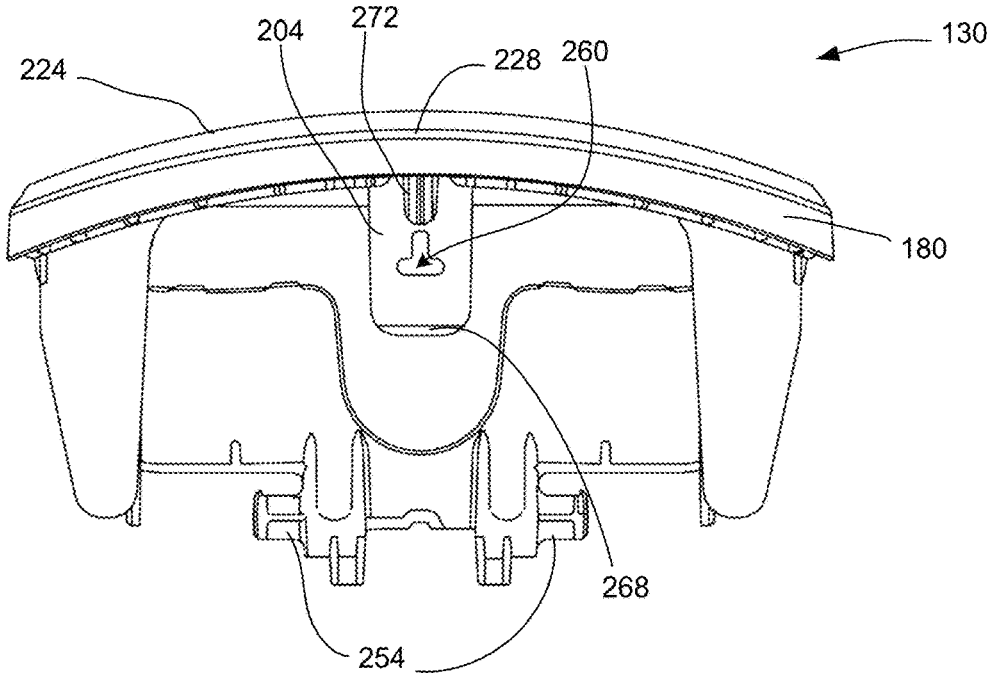
FIG. 3 illustrates a top plan view of a front panel of the dispenser shown in FIG. 1.

With continued reference to FIGS. 1 and 2, the front panel 130 includes a front wall 224 that spans across the perimeter 180. The front panel 130 has an outwardly bowed curvature. In other words, the front panel 130 has a curved profile in a side-to-side direction so that the front wall 224 bows, as illustrated in FIG. 3, to form a convex curvature with respect to the body 140 when provided in the closed position. Accordingly, the perimeter 180 of the front panel 130 includes a peak 228 that is located centrally thereon and at an uppermost point that is opposite a notch 232 formed at a lower section 236. A trigger 238 is configured to be pivotably coupled to the front panel 130 and mounted within the notch 232. The trigger 238 is substantially flush with the front wall 224 and the perimeter 180 in the lower section 236.

Referring to FIG. 2, the dispenser 110 further includes a support structure 244 for supporting the cartridge 120 in the dispenser 110, and a dispenser actuator 248. When assembled, fluid from the cartridge 120 is dispensed to a user by operation of the dispenser actuator 238. In addition, a hinge 252 is provided at the bottom end 156 of the body 140 for engagement with the front panel 130.

Figure 4:
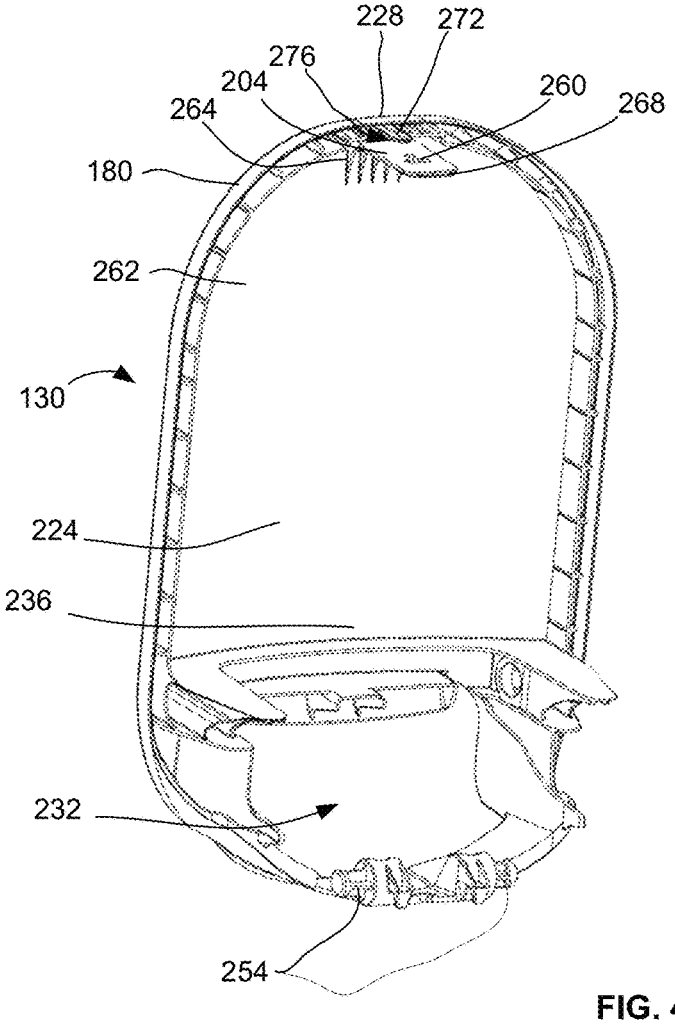
FIG. 4 illustrates a perspective view of a rear of the front panel 130 of FIG. 2.

With reference to FIGS. 3 and 4, a set of hinge arms 254 are provided at the lower section 236 of the front panel 130 for engagement with the hinge 252 at the bottom end 156 of the dispenser 110. In the illustrated embodiment, the hinge 252 is positioned at the bottom end 156 of the body 140 and the housing 212 is positioned at the top end 160. As such, the locking mechanism 208 (see FIG. 13) and the hinge 252 are provided at opposite ends of the dispenser 110. In one implementation, a stud 256 (see FIGS. 6 and 7) extends from the body 140 to engage the locking tongue 204 in the closed position. More specifically, the locking tongue 204 includes a slot 260 to receive the corresponding stud 256, thereby coupling the locking tongue 204 and stud 256 together. The housing 212 and release device 200 are also provided at an opposite end of the dispenser 110 to the hinge 252 i.e., at the top end 160.

In the illustrated embodiment of FIG. 4, the locking tongue 204 extends substantially perpendicularly from a rear surface 262 of the front wall 224 and includes a plurality of support ribs 264 to provide durability during repeated deflection during use. The locking tongue 204 includes a distal end 268 opposite the front wall 224 and the slot 260 is positioned on the locking tongue 204 between the distal end 268 and the front wall 224. As illustrated in FIGS. 3 and 4, the slot 260 extends vertically through the locking tongue 204 and is generally T-shaped to correspond with the shape of the stud 256. Further, the front panel 130 includes a set of reinforcing projections 272 that extend substantially perpendicularly to the front wall 224 from the peak 228 of the perimeter 180 of the front panel 130. The reinforcing projections 272 extend relatively parallel with the locking tongue 204 and are spaced above the locking tongue 204 to form a gap 276 therebetween. It shall be appreciated that in other embodiments, any suitable number of reinforcing projections may be used. For example, the front panel 130 may comprise a differently sized and shaped reinforcing projection, or greater or fewer reinforcing projections. Furthermore, the reinforcing projections 272 may be omitted altogether.

In the illustrated embodiment, the front panel 130 and the body 140 are pivotable or rotatable about the hinge 252 (shown in FIG. 2) to expose the interior cavity 152 and to permit access thereto. Additionally or alternatively, the front panel 130 and the body 140 may be completely detachable from each other without the use of the hinge 252. In some embodiments, the front panel 130 may be adapted to slide relative to the body 140 to expose or cover the interior cavity 152, or the front panel 130 may rotate in a different direction than shown. It is contemplated that the hinge 252 may be configured to include features for assistance or resistance to movement of the front panel 130 with respect to the body 140. For example, hinge arms 254 may carry a dampening protrusion (not shown), or a plurality thereof, for slowing or controlling movement of the front panel 130, such as, e.g., an elastic tab that provides resistance against movement of the front panel 130 in proportion to displacement (i.e., the greater the displacement, the greater the resistance). Additionally or alternatively, the hinge 252 can be biased to an intermediate position that is less than a total displacement, i.e., rotated approximately 90 degrees, of the front panel 130 relative to the body 140. Differently said, the hinge 252 may be biased to exert a resistive force upon the front panel 130 and/or the body 140 during relative movement therebetween.

In another aspect, a spring element (not shown) may be provided with the hinge 252 so as to contact the front panel 130 and the body 140, such that movement of the front panel 130 relative to the body 140 is impacted by a spring constant 'k' of the spring element. In one particular example, the spring element may have two arms extending from a coil, the first arm being coupled to the front panel 130 and the second arm being coupled to the body 140, and the spring element can be biased to a position that is 1-99% of the total displacement of the front panel 130 relative to the body 140. Differently said, the spring element may be biased to exert both an assistive force and a resistive force upon the front panel 130 and/or the body 140 during relative movement therebetween.

Figure 5:
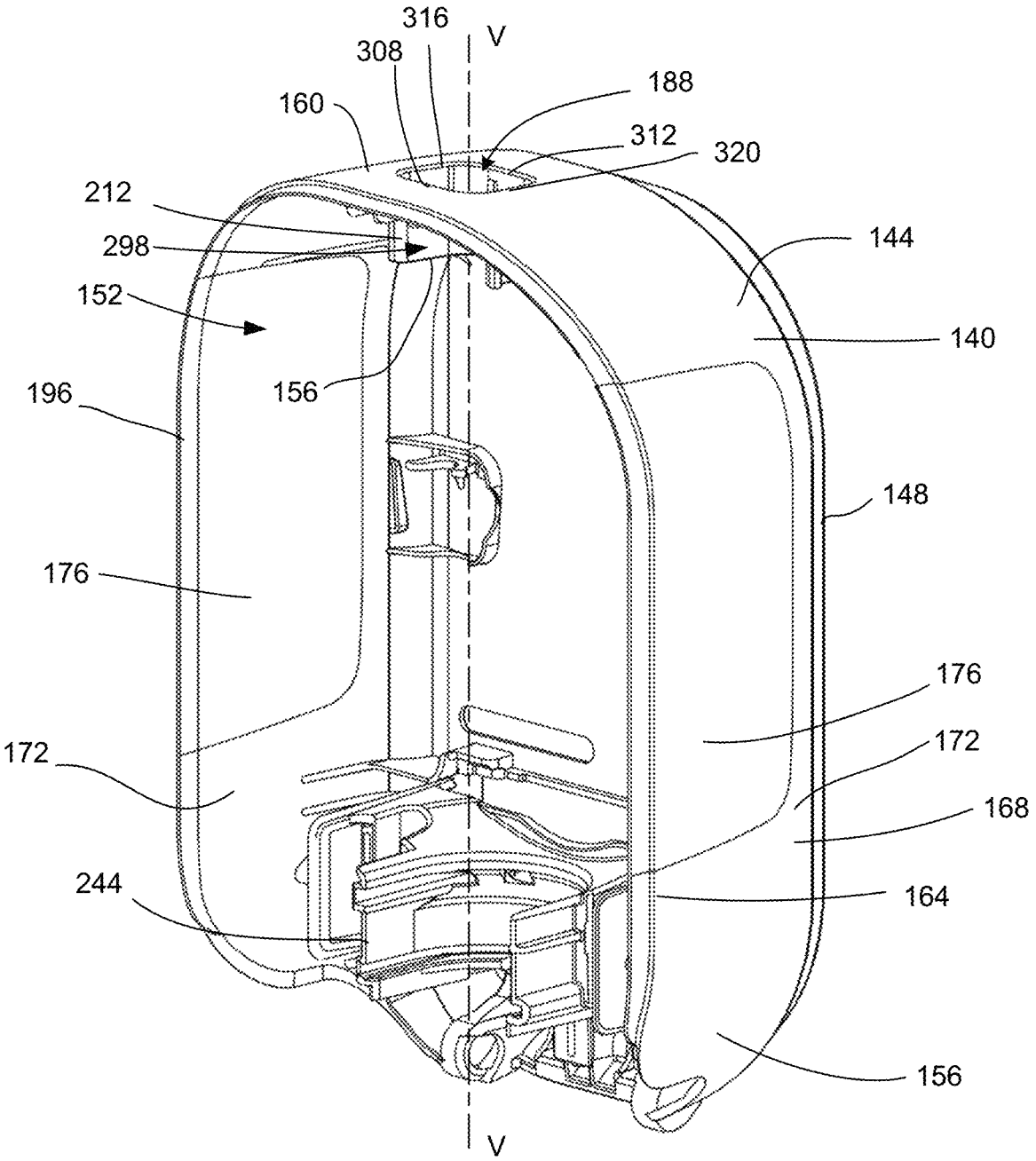
FIG. 5 illustrates a perspective view of a body of the dispenser of FIG. 1.

Turning to FIG. 5, the front end of the body 140 is curved in a vertical direction, such that the top end 160 of the sidewall 144 extends farther from the rear end 168 than the opposing sides 172 and the bottom end 156. The body 140, including the sidewall 144, is shaped and sized to fit tightly and substantially flush with the front panel 130, including with the perimeter 180 of the front panel 130. Accordingly, the dispenser 110 is configured to accommodate the housing 212 and release device 200 within the interior cavity 152 above the cartridge 120. However, it shall be appreciated that in other embodiments, the front panel 130 may be substantially flat, or the front panel 130 may be curved in another direction, such as, e.g., inwardly.

Figure 6:
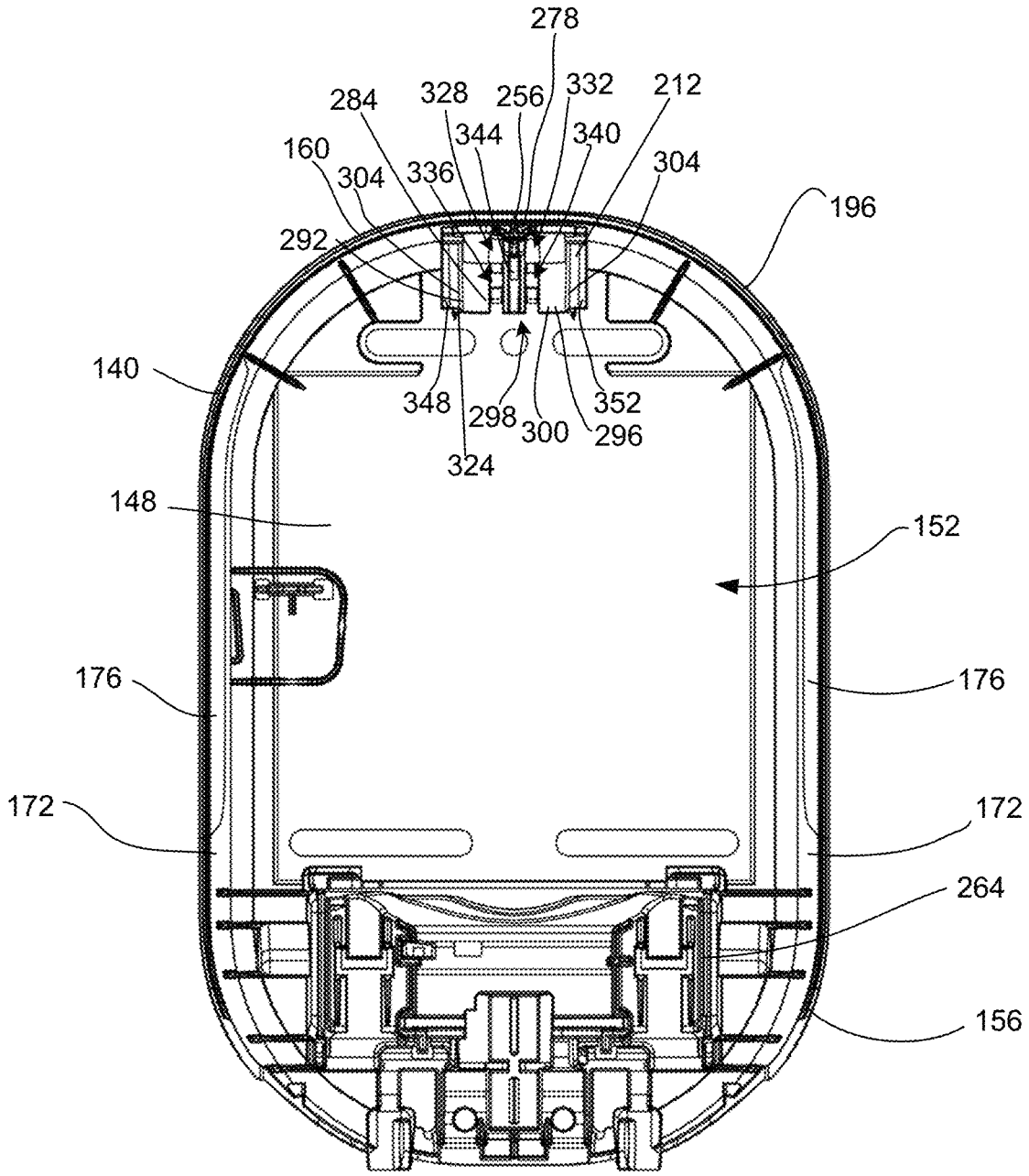
FIG. 6 illustrates a front elevational view of the body of FIG. 5.

Referring to FIGS. 5 and 6, the backplate 148 of the body 140 is configured to allow for mounting of the dispenser 110 to a suitable surface, such as a wall or on a free-standing floor mount, for example, via a series of mounts or screws or through the use of a suitable adhesive. Accordingly, placement of the mounting structure and/or fasteners are minimized within the interior cavity 152, allowing the cartridge 120 to occupy a greater percentage of the volume therein while keeping the cartridge 120 away from sharp edges that are prone to causing damage to the cartridge 120.

Figure 7:
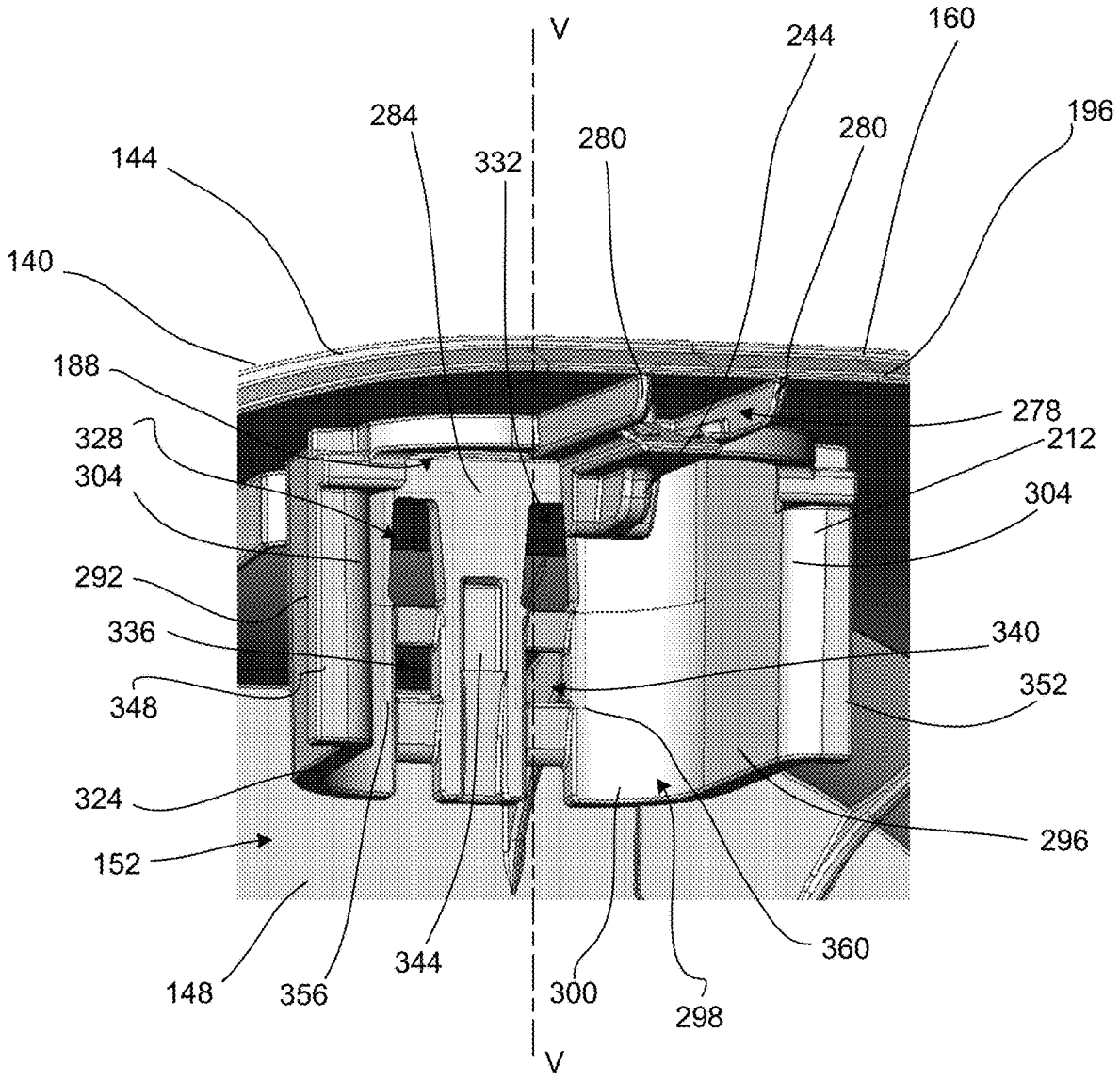
FIG. 7 illustrates a front, bottom, and side perspective view of a housing of the body shown in FIG. 6.

Referring to FIGS. 6 and 7, the stud 256 extends downwardly from the top end 160 of the sidewall 144 and into the interior cavity 152 to engage and/or mate with the slot 260 of the locking tongue 204. In this way, the locking tongue 204 (see FIG. 4) and the stud 256 form part of the locking mechanism 208 (see FIG. 13) of the dispenser 110 to releasably secure the front panel 130 to the body 140. It will be appreciated that the locking tongue 204 may instead be provided by the body 140 and the corresponding stud 256 provided by the front panel 130.

Referring to FIG. 6, the body 140 also comprises a receiving structure in the form of a nostril 278 that is bound by a pair of partitions 280 (see FIG. 7) and configured to receive the corresponding reinforcing projections 272 of the front panel 130 when the dispenser 110 is in the closed position. When the dispenser 110 is in the closed position, the reinforcing projections 272 assist with reinforcing the structural integrity of the sidewall 144 of the body 140, thereby preventing the dispenser 110 from being opened via forcibly deflecting the sidewall 144 about the locking tongue 204. However, it shall be appreciated that in other embodiments, any suitable number or shape of corresponding nostrils may be used. Furthermore, in another alternative, the corresponding nostril may be omitted altogether.

With reference to FIGS. 5-7, the body 140 comprises the housing 212, which is configured to house the release device 200 (see in FIG. 9) of the dispenser 110. Referring to FIG. 7, the housing 212 extends from the top end 160 of the sidewall 144 into the interior cavity 152. In one instance, the housing 212 is integrally formed with the sidewall 144. The housing 212, or portions thereof, may comprise a translucent or transparent material. However, it shall be appreciated that in other embodiments, the housing 212 may be provided as a separate component of different material or transparency than the sidewall 144. In the illustrated embodiment, the housing 212 is substantially cuboid in shape, although other configurations are possible.

Referring to FIG. 6, the housing 212 includes an engagement wall or rear housing wall 284 that is connected to opposing first and second housing side members 292, 296 that at least partially define a passage 298 for receiving the release device 200. The first housing member 292, which is a first housing wall, and the second side member 296, which is a second housing wall, extend into the interior cavity 152 from the top end 160 of the sidewall 144 adjacent the opening 188 and, further, each of the first and second side members 292, 296 curve from a back end 300 to a forward end 304. The housing 212 is generally open between the forward ends 304 for receiving the release device 200.

Referring to FIGS. 5 and 7, the opening 188 is configured to permit access to the passage 298 within the housing 212 from outside of the dispenser 110. In the illustrated embodiment, the opening 188 communicates with the passage 298 and defines an area that is approximately equivalent to a cross-sectional area of the passage 298. The opening 188 is generally square-shaped and is defined by a front edge 308 opposite a rear edge 312 and opposing side edges 316, 320, but other configurations are possible. Further, a vertical axis V extends centrally through the opening 188 and the passage 298, such that the opening 188 and the passage 298 are collinear with each other. In addition, the passage 298 extends from the opening 188 in the sidewall 144 to the interior cavity 152 at an open bottom end 324 of the housing 212.

The engagement wall 284 of the housing 212 includes engagement features in the form of a pair of channels 328, 332, a pair of apertures 336, 340, and a central track 344, as illustrated in FIG. 7. Each side member 292, 296 includes a respective first rail 348 and a second rail 352 extending substantially perpendicularly from the forward end 304 thereof and in opposing directions from each other. Accordingly, the rails 348, 352 are coplanar with each other and spaced apart from the engagement wall 284 at the back end 300 of the housing 212. In some embodiments, each rail 348, 352 may include a taper therealong, such as, e.g., in widening or extending in a vertical direction. The stud 256 is located near the front edge 308 (see FIG. 13) of the opening 188 and approximately centrally between the first and second rails 348, 352 (see FIGS. 6 and 7).

As illustrated in FIG. 7, the pair of channels 328, 332 and the track 344 are provided in a first triangular formation or pattern. Similarly, the pair of apertures 336, 340 and the track 344 are also provided in a second triangular formation or pattern that is inverted relative to the first triangular formation. The pair of channels 328, 332 are located coplanar with the pair of apertures 336, 340 and closer to the top portion 160 of the body 140 than the pair of apertures 336, 340, such that the pair of channels 328, 332 are spaced vertically above the pair of apertures 336, 340. The pair of channels 328, 332 each extend a greater distance in a vertical direction than each of the pair of apertures 336, 340 and, thus, the pair of channels 328, 332 each define a greater volume than each of the pair of apertures 336, 340. The track 344 is located approximately centrally between the pair of channels 328, 332 and the pair of apertures 336, 340, and the track 344 is formed by a recess in the engagement wall 284, so as not to extend through the engagement wall 284. However, in some embodiments, the track 344 may instead extend through the engagement wall 284.

Figure 8:
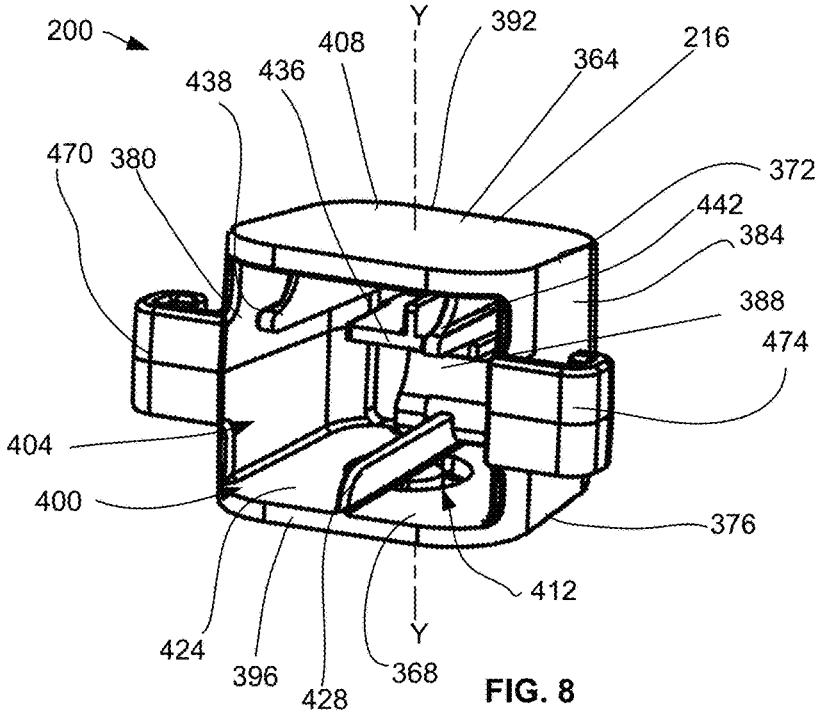
FIG. 8 illustrates a front, top, and side perspective view of a release device of the dispenser of FIG. 1 when in a first orientation.

Further, each of the channels 328, 332 and each of the apertures 336, 340 are laterally spaced from the vertical axis V. In the illustrated embodiment, the pair of channels 328, 332 and the pair of apertures 336, 340 are equidistant from the vertical axis V. In other embodiments, each channel 328, 332 and/or each aperture 336, 340 may be spaced a different distance relative to the vertical axis V. As best seen in FIGS. 7 and 8, the first channel 328 and the first aperture 336 form a first vertical set 356 located substantially the same distance from the vertical axis V, and a second channel 332 and a second aperture 340 form a second vertical set 360 located substantially the same distance from the vertical axis V. The first channel 328 and the first aperture 336 are spaced vertically from each other a distance that is equal to a distance that the second channel 332 and the second aperture 340 are spaced vertically from each other. In addition, the first channel 328 and the first aperture 336 (i.e., the first vertical set 356) are disposed adjacent the first side member 292, and the second channel 332 and the second aperture 340 (i.e., the second vertical set 360) are located adjacent the second side member 296. In some embodiments, the channels 328, 332 and the apertures 336, 340 may be located on one or both of the side members 292, 296.

Turning to FIGS. 8-11, the release device 200 has a shape corresponding to that of the housing 212 to enable the release device 200 to be inserted into the housing 212 during use. In the illustrated embodiment, the release device 200 is substantially cuboid, although it shall be appreciated that in other embodiments the release device may be of any other suitable shape.

Figure 9:
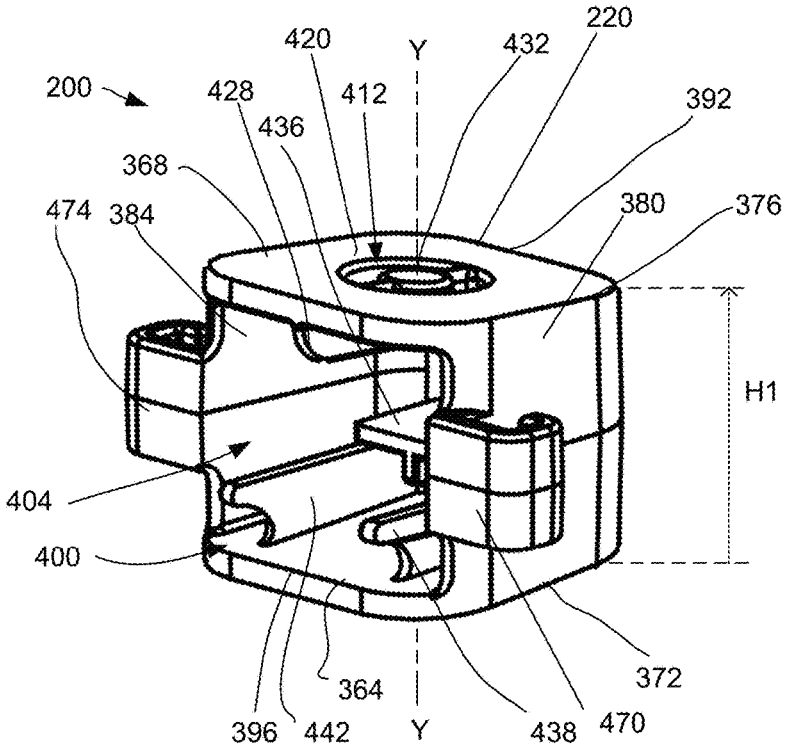
FIG. 9 illustrates a front, top, and side perspective view of the release device shown in FIG. 8 when in a second orientation.

In the illustrated embodiment of FIGS. 8-11, the release device 200 comprises a first wall or button wall 364 and a second wall or key wall 368 at opposite first and second ends 372, 376 of opposing flank sides or flank walls 380, 384 that extend between the button wall 364 and the key wall 368. Each of the button wall 364 and the key wall 368 define a generally rectangular perimeter. Further, a rear wall or bridge 388 spans across a dorsal end 392 of the release device 200 and connects to the button wall 364 and the key wall 368, while a ventral end 396 of the release device 200 provides an open port 400 that communicates with a chamber 404. Accordingly, the button wall 364 and the key wall 368 are spaced apart from each other, separated by the flank walls 380, 384 and the chamber 404, and on opposite ends 372, 376 of the release device 200. In addition, the flank walls 380, 384 extend along the button wall 364 and the key wall 368 from the dorsal end 392 to the ventral end 396. An axis Y extends centrally between and substantially parallel to the flank walls 380, 384. In addition, the flank walls 380, 384 define a height H1 in the direction of axis Y between the first release feature 216 and the second release feature 220, as illustrated in FIG. 9. In addition, the height H1 varies between the ventral end 396 and the dorsal end 392 of the release device 200 and, in one instance, the height H1 is greater at the ventral end 396 than at the dorsal end 392. Differently said, the release device 200 narrows from the ventral end 396 to the dorsal end 392, such that the button wall 364 and the key wall 368 are each disposed at an angle relative to the axis Y.

As previously mentioned, the first release feature 216 and the second release feature 220 are each configured to enable release of the locking mechanism 208 and are integrally formed as part of the release device 200 such that the release device 200 is provided as a single unitary component. The button wall 364 of the release device 200 provides the first release feature 216 which is configured to enable release of the locking mechanism 208 in a first manner. Further, the key wall 368 of the release device 200 provides the second release feature 220 which is configured to enable release of the locking mechanism 208 in a second manner, different to that of the first release feature 216. Accordingly, the first release feature 216 and the second release feature 220 are spaced apart from each other and on opposite sides of the release device 200.

Referring to FIGS. 8-11, the first release feature 216 is provided in the form of an uninterrupted outer surface 408 of the button wall 364, which can be depressed as a button. In the illustrated embodiment, the first release feature 216 includes substantially the entire outer surface 408 of the button wall 364, although other configurations are possible. It is contemplated that the button wall 364 may be provided with a coating, such as, e.g., an antimicrobial coating for enhanced sanitation.

Additionally or alternatively, the button wall 364 of the release device 200 may include indicia, recesses, apertures, voids, interruptions, and/or other features thereon, which are provided in concert with the first release feature 216. For example, the button wall 364 may include an appearance of a key hole, whether due to color or recesses or a combination thereof, to discourage unauthorized users from opening the dispenser 110, i.e., anti-tampering indicia.

Further, the release device 200 may include a sensor or a transducer operably embedded therein and/or protruding therefrom, such as, e.g., a fingerprint sensor, a proximity sensor, a vibrometer, an inductive sensor, a capacitive displacement sensor, a magnetic eddy-current sensor, an ultrasonic sensor, a Hall Effect sensor, or any other suitable device for capturing, measuring, or storing information regarding motion, position, or identification associated with the use of the dispenser 110 and/or release device 200. It is further contemplated that such a sensor or transmitter, or pluralities thereof, may be provided in any suitable location on the dispenser 110 for capturing, measuring, storing, transmitting, or communicating information associated with the user or operation of the dispenser 110.

In some embodiments, the release device 200 may include a transmitter operably embedded therein or protruding therefrom, such as, e.g., an antenna or a transceiver, or any other suitable device for transmitting or communicating signals, including WiFi signals, radio signals, or other telecommunications or electronically produced signals associated with the use of the dispenser 110 and/or release device 200. For example, the release device 200 may include wired or wireless network interfaces (not shown), such as, e.g., processors, memory, storage, antennae, etc., and software, to enable communication with external networks and/or with one another. In some instances, the release device 200 includes a wired or wireless interface (not shown), e.g., an auxiliary port, a Universal Serial Bus (USB) port, a Bluetooth® wireless node, etc., to communicatively couple with a mobile device, e.g., a smartphone, a smart watch, etc. In such embodiments, the release device 200 may communicate with the external network via the mobile device. The external network may be a public network, such as the Internet; a private network, such as an intranet; or combinations thereof, and may utilize a variety of networking protocols now available or later developed including, but not limited to TCP/IP-based networking protocols.

Figure 10:
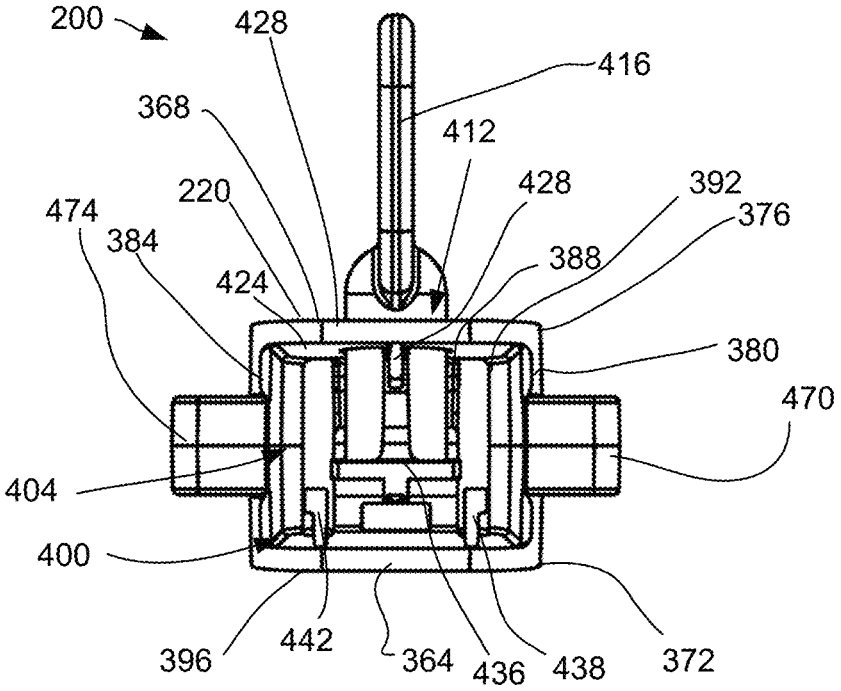
FIG. 10 illustrates a front-view of the release device of FIG. 8 when in the second orientation and in which a tool is inserted into the second release feature.

Meanwhile, in the illustrated embodiment of FIGS. 9 and 10, the second release feature 220 includes a tool receptacle, in this case a key receptacle 412 provided through the key wall 368 in the form of an open ring, configured for receiving a corresponding tool or key 416. Further, the key wall 368 includes an outer surface 420 that is opposite an inner surface 424 along which a divider 428 extends between the ventral end 396 and the dorsal end 392. The divider 428 supports a hub 432 that extends into the key receptacle 412. In this way, the key receptacle 412 is shaped to correspond with the particular shape of the key 416. Accordingly, the divider 428 and the hub 432 together block the key receptacle 412 to prevent access to deflect the locking tongue 204 by unauthorized users and/or by accident. However, it shall be appreciated that, in other embodiments, the key receptacle 412 and key 416 may be of any other suitable shape, or, in a further alternative, any other suitable release feature may be used.

Referring to FIG. 10, the open port 400 is provided opposite to the bridge 388 to provide access to the chamber 404 of the release device 200. A stop member 436 projects from an interior of the bridge 388 into the chamber 404 toward the ventral end 396, being spaced apart from the key wall 368 and disposed closer to the button wall 364 than to the key wall 368. The stop member 436 has a generally T-shaped profile, and the stop member 436 forms a cantilever about the bridge 388 to prevent deflection of the locking tongue 204 beyond its elastic limit when pressed upon by the key 416 in the second configuration. The stop member 436 is disposed coaxially with the key receptacle 412 of the key wall 368 relative to the axis Y. The bridge 388 is positioned centrally between the flank walls 380, 384 and spaced apart from each of the flank walls 380, 384. Accordingly, the bridge 388 is thinner and less rigid than the flank walls 380, 384 and, as such, the bridge 388 is configured to provide greater flexibility, such as, e.g., for allowing the stop member 436 to bend or flex when in contact with the locking tongue 204 (see FIG. 13).

As can be appreciated from FIG. 10, the chamber 404 defines a volume that is at least 30% but not greater than 70% of the total volume of the release device 200. Accordingly, the release device 200 is substantially hollow. In some embodiments, the chamber 404 may define a volume that is greater than 70% or less than 30% of the total volume of the release device 200.

As seen in FIGS. 9 and 10, a set of ridges 438, 442 are provided within the chamber 404 extending from an interior side of the button wall 364 toward the key wall 368 and, further, extending substantially between the ventral end 396 and the dorsal end 392. The ridges 438, 442 are configured to act on the locking tongue 204 during operation of the release device 200. In the illustrated embodiment, the ridges 438, 442, are provided as a pair of ridges. However, it shall be appreciated that in other embodiments any number of ridges 438, 442 may be used, including a single ridge or, in other embodiments, the ridges may be omitted and an inner surface of the button wall 364 may be configured to act on the locking tongue 204.

Figure 11:
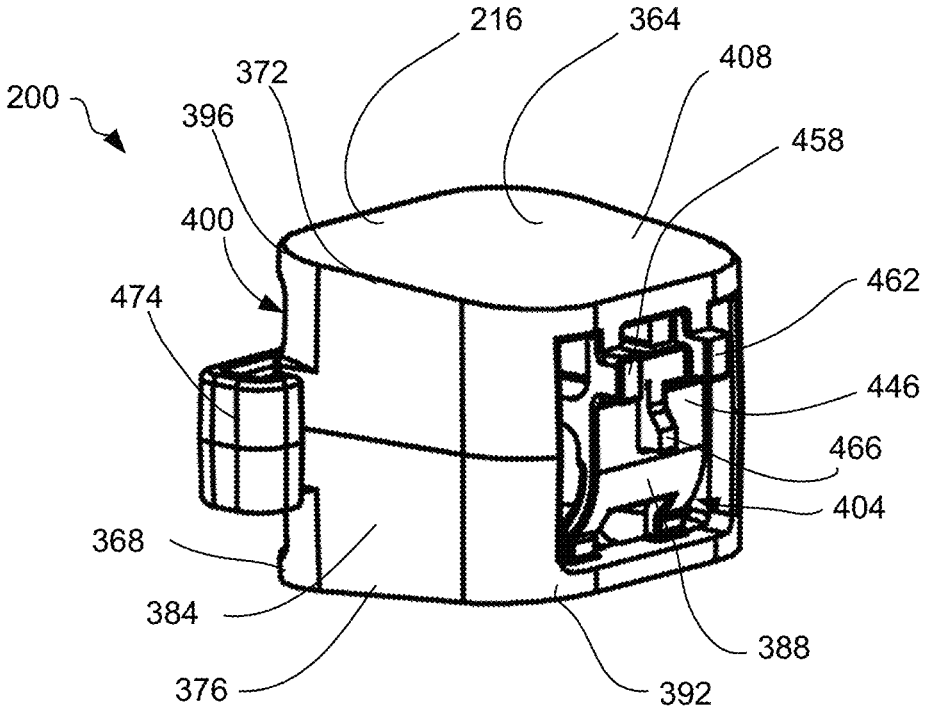
FIG. 11 illustrates a rear, top, and side perspective view of the release device of FIG. 8.

Referring now to FIG. 11, an exterior side 446 of the bridge 388 of the release device 200 comprises engaging features in the form of a plurality of projections including a pair of posts 458, 462 and a central prop 466. The plurality of projections are arranged in a triangular formation that is offset toward the button wall 364. More specifically, the central prop 466, also referenced herein as a first projection, is positioned substantially centrally between a pair of posts 458, 462, also referenced herein as a second projection and a third projection. Further, the central prop 466 is located substantially centrally between the first end 372 and the second end 376. When the release device 200 is in the first orientation with the button wall 364 positioned above the key wall 368, the release device 200 presents a first triangular formation of the projections in which the prop 466 is positioned below the posts 458, 462, as seen in FIG. 11. When the release device 200 is flipped over into the second orientation and the key wall 368 is positioned above the button wall 364, the release device 200 presents a second triangular formation of the projections in which the prop 466 is positioned above the posts 458, 462. Thus, the first and the second triangular formations of the projections are inverses of each other.

Turning to FIGS. 8-10, the release device 200 of the illustrated embodiment also comprises a guide structure in the form of a pair of guide hooks 470, 474, which is a first guide hook 470 and a second guide hook 474, that are configured to interact with the corresponding rails 348, 352 of the sidewalls 144 of the housing 212 (see FIGS. 12 and 14) to help ensure stability of the release device 200 within the housing 212. In particular, each guide hook 470, 474 extends outwardly from the ventral end 396 of the flank wall 380, 384, respectively, in opposite directions from each other, as seen in FIGS. 8-10. Accordingly, the guide hooks 470, 474 are coplanar with each other and spaced apart from the bridge 388 at the dorsal end 392. Further, the guide hooks 470, 474 are each disposed adjacent to the port 400 and substantially centrally between the button wall 364 at the first end 376 and the key wall 368 at the second end 376. However, it shall be appreciated that in other embodiments, any other suitable guide structure may be used, or, in a further alternative, the guide structure may be omitted.

Figure 12:
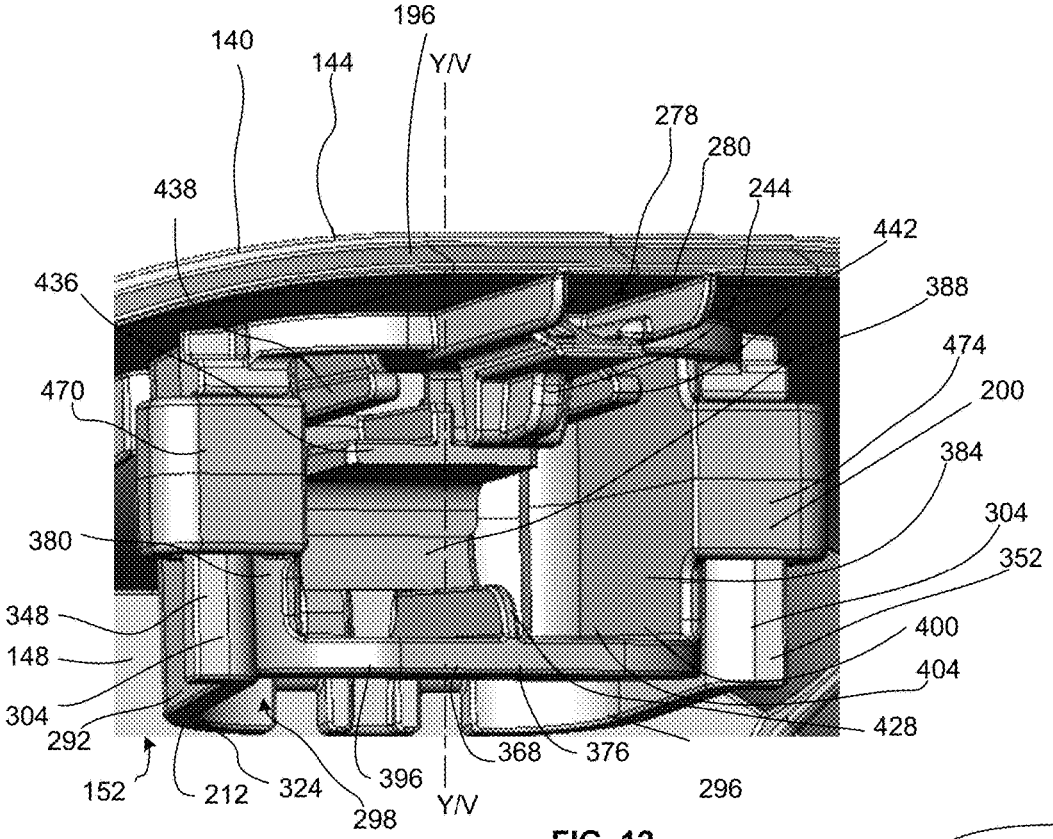
FIG. 12 illustrates a front, bottom, and side perspective view of the release device of FIG. 8 being received within the housing of the body in the first configuration.
Figure 13:
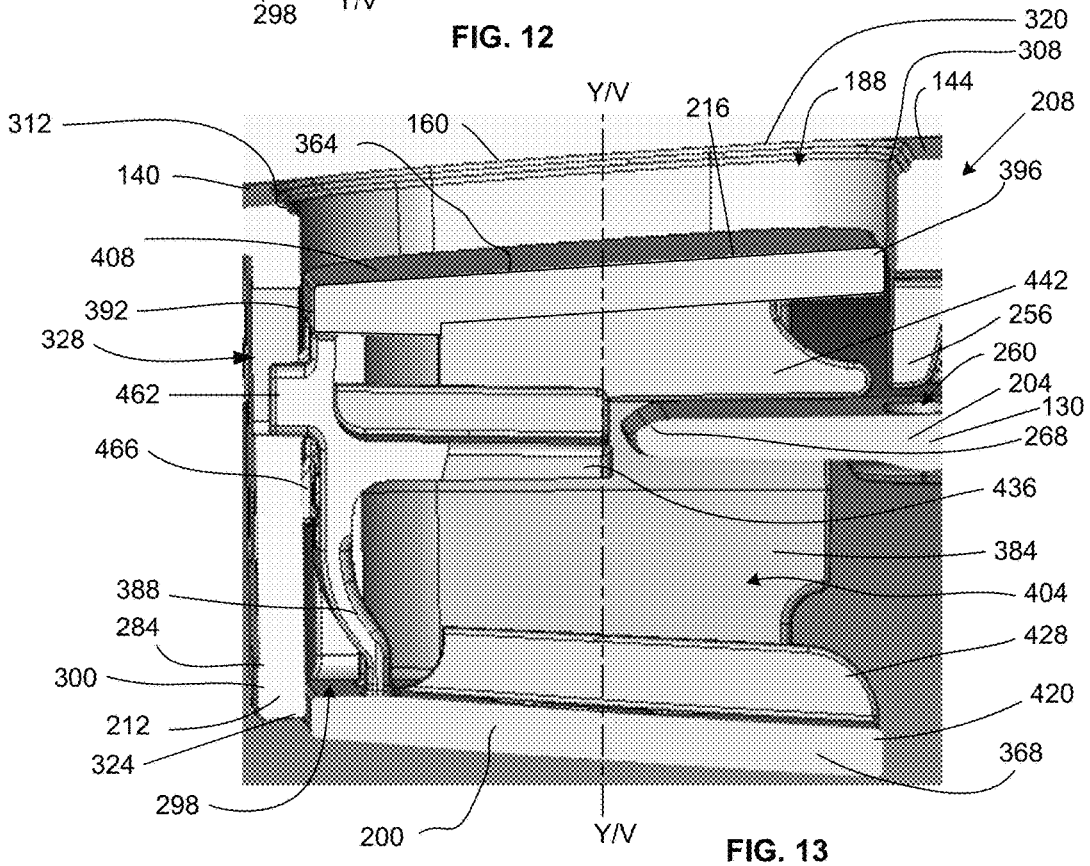
FIG. 13 illustrates a rear, top, and side perspective cross-sectional view of the dispenser assembly of FIG. 1 taken along section line 13-13 of FIG. 1 and depicting the release device and locking tongue in a depressed state.

In applications where ease of use for maintenance professionals is of primary importance, the release device 200 may be inserted into the housing 212 in a first orientation, as illustrated in FIGS. 12 and 13, such that the button wall 364 is disposed within the opening 188 and the key wall is disposed within the passage 298 near the open bottom end 324.

In the first orientation, the release device 200 is received via the opening 188 of the body 140 such that the outer surface 408 of the button wall 364 of the release device 200 is presented to a user substantially flush with the surface of the sidewall 144 of the dispenser 110 (see FIG. 1). In the first orientation, the distal end 268 of the locking tongue 204 is received within the internal cavity 152 such that the pair of ridges 438, 442 located at button wall 364 abut against the locking tongue 204, which is inserted therein.

As will be appreciated from FIG. 13, when the release device 200 is inserted in the first orientation to form the first configuration, the third projection 462 of the release device 200 is received by the first channel 328 of the housing 212. Accordingly, although not visible from the sectional side view of FIG. 13, the second projection 458 is received by the second channel 332 and the first projection 466 is received by the track 344. Put another way, when the release device 200 is in the first configuration and the button wall 364 is disposed in the opening 188, the first triangular formation of the projections is configured to correspond with the first triangular formation of the engagement features of the engagement wall 284 of the housing 212. In particular, the posts 458, 462 and the prop 466 of the release device 200 are received within the channels 328, 332 and track 344, respectively, of the housing 212. Further, the guide hooks 470, 474 of the release device 200 receive the respective rails 348, 352 of the side members 292, 296 of the housing 212. In some embodiments, the rails 348, 352 and the guide hooks 470, 474, respectively, may be configured to exert greater frictional resistance to the downward translation of the release device 200 in the housing 212, such as by having a tapered shape or increased dimension near the bottom end 324, or by including textured surfaces.

Further, when the release device 200 is inserted in the first orientation, the entire opening 188 is occupied by the surface 408 of the button wall 364, which has substantially the same area as the opening 188, as seen in FIG. 1. Referring to FIGS. 12 and 13, the axis Y of the release device 200 is positioned coaxially with the vertical axis V of the aperture.

As best seen in FIG. 13, to open the dispenser 110 when the release device 200 is in the first configuration, the user simply exerts a force on, i.e., depresses, the outer surface 408 of the button wall 364, which causes the release device 200 to translate along the vertical axis V within the housing passage 298 of the housing 212 of the dispenser 110. The translation of the release device 200 causes the ridges 438, 442 to deflect the locking tongue 204 by exerting a downward force on the locking tongue 204. As the locking tongue 204 becomes deflected, the slot 260 is moved away from the stud 256 to release the locking tongue 204 from the body 140, which then allows the front panel 130 to be opened. Differently said, the release device 200 is translated within the passage 298 to deflect the locking tongue 204, such that the slot 260 of the locking tongue 204 is moved out of engagement with the locking stud 256 of the body 140. In this way, the locking tongue 204 is displaced from a locked position, i.e., contacting and engaged with the stud 256, to an unlocked position, i.e., separated from and disengaged with the stud 256, to release the front panel 130 from the body 140.

As will be appreciated from FIG. 13, as well as from the first triangular formation of the engagement features described in connection with FIG. 7 and the first triangular formation of projections described in connection with FIG. 11, the release device 200 is translated within the passage 298 of the housing 212 toward the cartridge 120 disposed within the interior cavity 152, the posts 458, 462 slide within the channels 328, 332, respectively, and the prop 466 slides within the track 344. The guide hooks 470, 474 also slide along the rails 348, 352 of the housing 212 to help ensure correct alignment between the housing 212 and the release device 200. As such, the channels 328, 332 and the track 344 of the housing 212 guide vertical translation of the release device 200 within the passage 298 of the housing 212 in the first configuration. As a result, a generally linear translation is achieved along the vertical axis V. It is contemplated that translation can occur in a non-linear fashion, such as along a curved path or involving a twisting or rotating motion.

Still referring to FIG. 13, when the release device 200 has been sufficiently translated to facilitate release of the locking mechanism 208, the projections abut against a bottom surface of the respective channel 328, 332, thereby preventing any further translation of the release device 200 relative to the housing 212. In the illustrated embodiment, the locking tongue 204 is resilient, reinforced by the support ribs 264, and, thus, when a user ceases to apply a force to the surface 408, the locking tongue 204 lifts the ridges 438, 442 of the release device 200 as it deflects back to its original position, thereby translating the release device 200 along the vertical axis V back to its starting position (see FIG. 12), where the first release feature 216 is flush with the sidewall 144 of the body 140. However, it shall be appreciated that in other embodiments, the locking tongue 204 may be returned via a spring or any other suitable biasing means.

Figure 14:
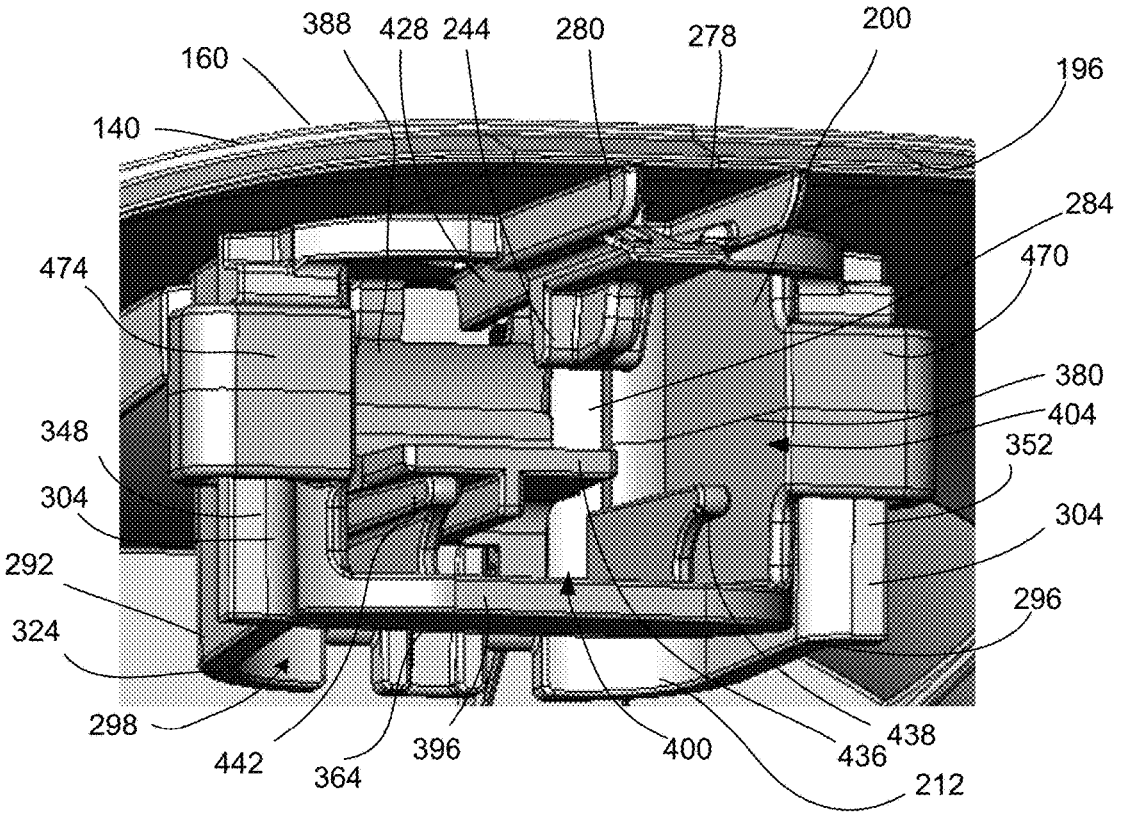
FIG. 14 illustrates a front, bottom, and side perspective view of the release device of FIG. 8 being received within the housing of the body in the section configuration.

In applications where securing the contents of the dispenser 110 against unauthorized access is of primary importance, the release device 200 can be removed from the housing 212, rotated 180 degrees top-to-bottom, and re-inserted in the second orientation to form the second configuration of FIG. 14. In the illustrated embodiment, the key wall 368 is disposed within the opening 188 at the top and the button wall 364 is oriented at the bottom. In other words, the release device 200 can be flipped over and re-installed in the housing 212 in the second orientation.

Figure 15:
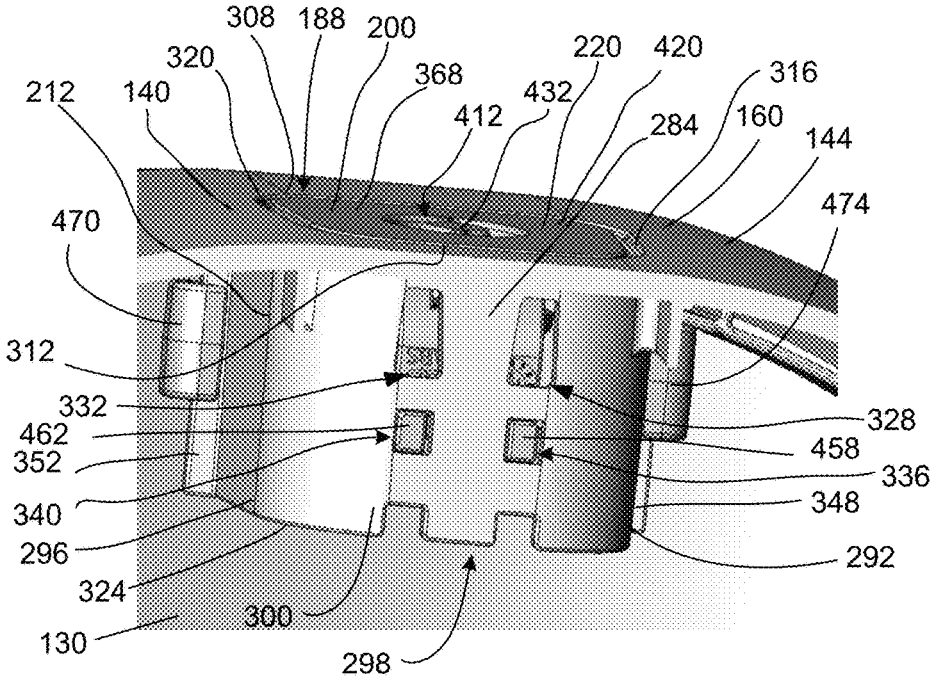
FIG. 15 illustrates a rear, top, and side perspective cross-sectional view of the dispenser assembly of FIG. 1 taken along section line 15-15 of FIG. 1 and depicting the release device in the second configuration.

Referring to FIGS. 14 and 15, the release device 200 is received in the housing 212 in the second configuration such that the outer surface 420 of the key wall 368 of the release device 200 is exposed through the opening 188 and substantially flush with the sidewall 144. In the second configuration, the distal end 268 of the locking tongue 204 is still received within the chamber 404, but it is not abutted by the plurality of ridges 438, 442 in this instance.

Further, when the release device 200 is inserted in the second orientation, the entire opening 188 is occupied by the outer surface 420 of the key wall 368, which defines an area that is less than the area of the opening 188, and a central point of the key wall 368 is substantially positioned along the vertical axis V of the aperture. In this second orientation, the release device 200 is configured to remain stationary within the housing 212. Also, in the second orientation, the stop member 436 is positioned coaxially below the key receptacle 412 to provide a space in which the key 416 may be received to deflect the locking tongue 204 sufficiently enough to disengage the stud 256 and the locking tongue 204.

Referring to FIG. 15, when the release device 200 is inserted in the second orientation, the projections 458, 462, 466 of the release device 200 interact with the engagement features 328, 332, 344 of the housing 212. Put another way, when the release device 200 is in the second configuration with the key wall 368 disposed in the opening 188 of the sidewall 144, the second triangular formation of the projections corresponds with the second triangular formation of the engagement features on the engagement wall 284 of the housing 212. It will be appreciated that the track 344 and the apertures 336, 340 cooperate to receive the projections without allowing for translation in this configuration. In particular, the posts 458, 462 and the prop 466 (see FIG. 11) are received within the apertures 336, 340 and track 344 respectively, of the housing 212. In the illustrated embodiment, the projections 458, 462, 466 are configured such that, when the release device 200 is in the second orientation, a snap-fit is formed with the respective aperture 336, 340 to releasably couple the release device 200 to the housing 212 such that movement of the release device 200 relative to the housing 212 is substantially prevented. However, it shall be appreciated that other types of suitable interconnection may be used.

As best seen in FIG. 15, the shape of the posts 458, 462 are configured to interact with the apertures 336, 340 of the housing 212 in the second configuration and, as seen in FIG. 13, with the channels 328, 332 of the housing 212 in the first configuration. However, the central prop 466 is configured to interact with the track 344 in both first and second configurations. It shall also be appreciated that in alternative embodiments, one or more projections may be located on any suitable surface, and furthermore, in another embodiment, the release device may alternatively comprise an aperture and/or channel configured to interact with a corresponding tab located at the housing.

Referring to FIGS. 14 and 15, the guide hooks 474, 470 of the release device 200 receive the respective rails 348, 352 of the housing 212 to further secure the release device 200 therein. For example, rails 348, 352 and the guide hooks 474, 470 prevent rotation of the release device 200 about the interconnection between the projections and the engagement wall 284 of the housing 212.

As will be appreciated from FIGS. 10 and 14, to open the dispenser 110 when the release device 200 is in the second configuration, a user must insert a key 416 into the key receptacle 412. As the key 416 is inserted through the key receptacle 412 and into the chamber 404 the key 416 pushes against the locking tongue 204 causing it to deflect in a similar manner as shown in FIG. 13, such that the locking tongue 204 is deflected, the slot 260 of the locking tongue 204 moves out of engagement with the locking stud 256 of the body 140, and the front panel 130 is released from the body 140. Accordingly, the locking tongue 204 is configured to be moved by translation of the release device 200 within the housing 212 in the first orientation, and the locking tongue 204 is configured to be moved relative to the release device 200 within the housing 212 in the second orientation. Further, the first and second guide hooks 470, 474 are configured to engage the first and second rails 348, 352, respectively, in the first orientation, and the first and second guide hooks 470, 474 are configured to engage the second rail 352 and the first rail 348, respectively, in the second orientation.

As the locking tongue 204 is deflected to a pre-determined point, the distal end of the locking tongue 204 is brought into contact with the stop member 436, thereby restricting deflection of the locking tongue 204 of the dispenser 110. The position of the stop member 436 is chosen to prevent the locking tongue 204 from being deflected past its elastic limit and thereby helps to provide the dispenser assembly 110 with improved durability.

As has been discussed previously, in the illustrated embodiment, the locking tongue 204 is resilient. Therefore, when the key 416 is removed from the key receptacle 412, the locking tongue 204 subsequently deflects back to its original position.

In this manner, the dispenser assembly 100 is provided as having interchangeable locking capabilities, which can be quickly and easily moved between configurations by a user, depending on location requirements. It will be appreciated that when the release device 200 is inserted into the housing 212 of the dispenser 110 in either the first orientation or the second orientation, the chamber 404 is configured to receive the distal end 268 of the locking tongue 204 through the port 400 when the dispenser 110 is in the closed position, as illustrated in FIG. 13.

It is contemplated that the stud 256 can include a groove or notch into which a portion of the locking tongue 204 may snap-fit, thereby causing an audible "click" or other suitable sound typically recognized as confirmation that a secure fit between the front panel 130 and the body 140 has been accomplished. Additionally or alternatively, the stud 256 may include a projection (e.g., a rib, a nub, or the like) disposed laterally and located approximately centrally such that a portion of the locking tongue 204 must pass over the projection to securely snap-fit with the stud 256. Thus, the projection, whether in combination or in lieu of the groove or notch, also provides a snap-fit causing an audible "click" or other suitable sound typically recognized as confirmation that a secure fit between the front panel 130 and the body 140 has been accomplished.

Further, it is contemplated that the release device 200 may be provided with a ramp or inclined surface along which the distal end of locking tongue 204 may slide during translation of the release device 200 in the first configuration, second configuration, or both. The ramp or inclined surface may exert a compressive force against the distal end of the locking tongue 204 so as to assist with movement of the front panel 130 about the hinge 252. While the respective release features are described in the illustrated embodiments as being located on the first and second walls of the release device, in alternative embodiments, it shall be appreciated that the first and/or second release features may be provided on other walls of the release device. Furthermore, while various components have been described herein as being located at the front panel or body, it shall be appreciated that the location of these components may be inverted, and hence the components described in the illustrated embodiments as being located on the front panel may alternatively be located on the body and vice versa.

Referring to FIGS. 16-19, another embodiment of a dispenser 500 is depicted, which works in a similar way to the embodiment described in FIGS. 1-15 but includes a different release device configuration. For the sake of conciseness, only the differences between embodiments shall be described. Equivalent parts of the second embodiment use equivalent labels to that of the first embodiment.

Figure 16:
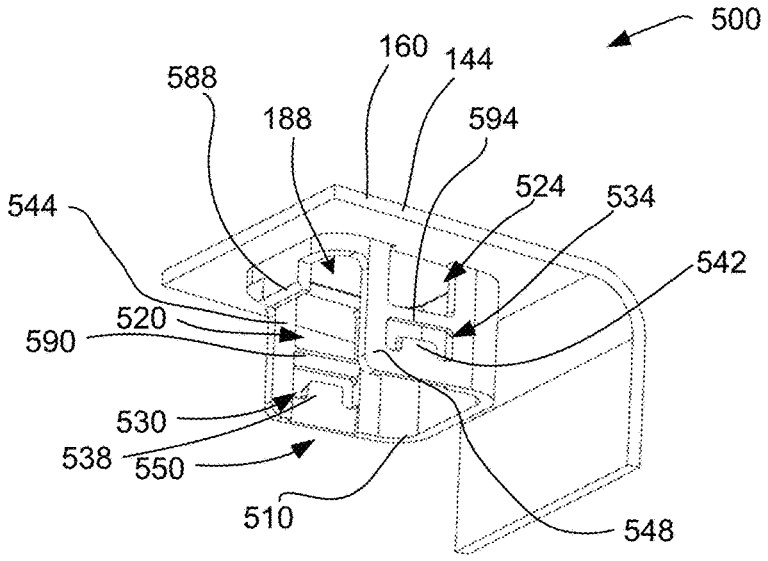
FIG. 16 illustrates a perspective view of a housing of a dispenser according to an alternative embodiment.
Figure 17:
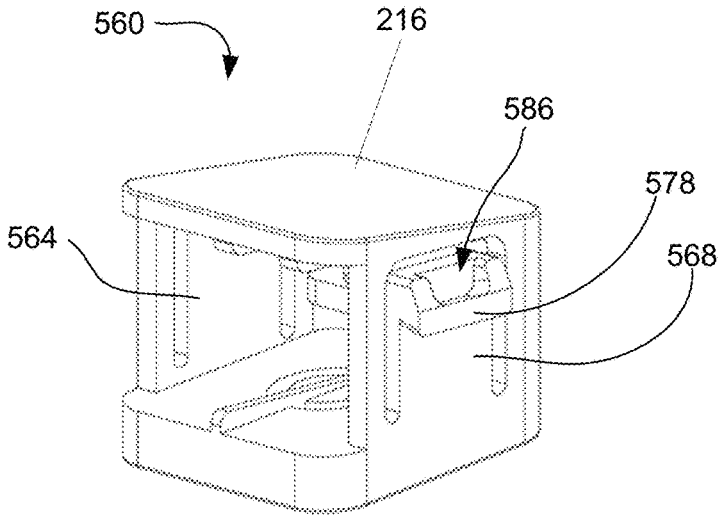
FIG. 17 illustrates a perspective view of a release device according to an alternative embodiment.
Figure 18:
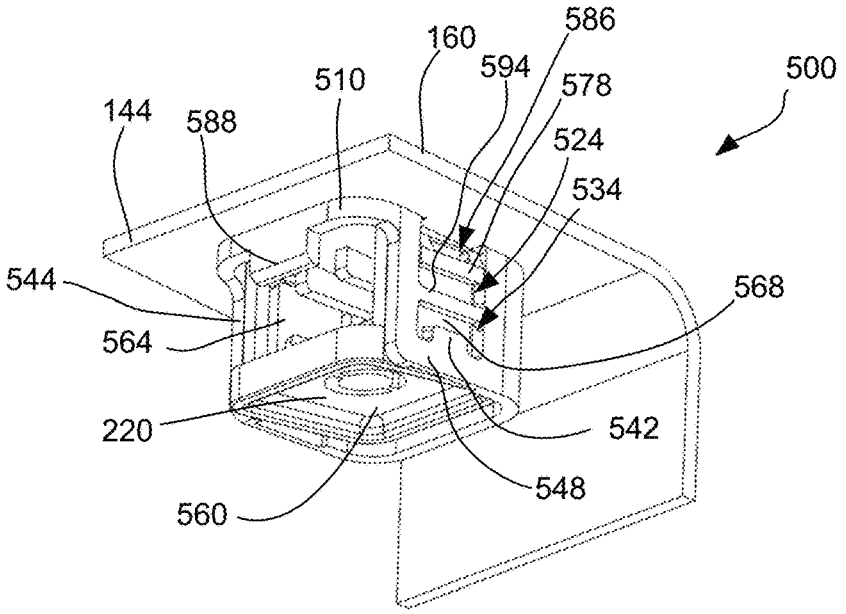
FIG. 18 illustrates a perspective view of the housing shown in FIG. 17 in which the release device is received in a first configuration.
Figure 19:
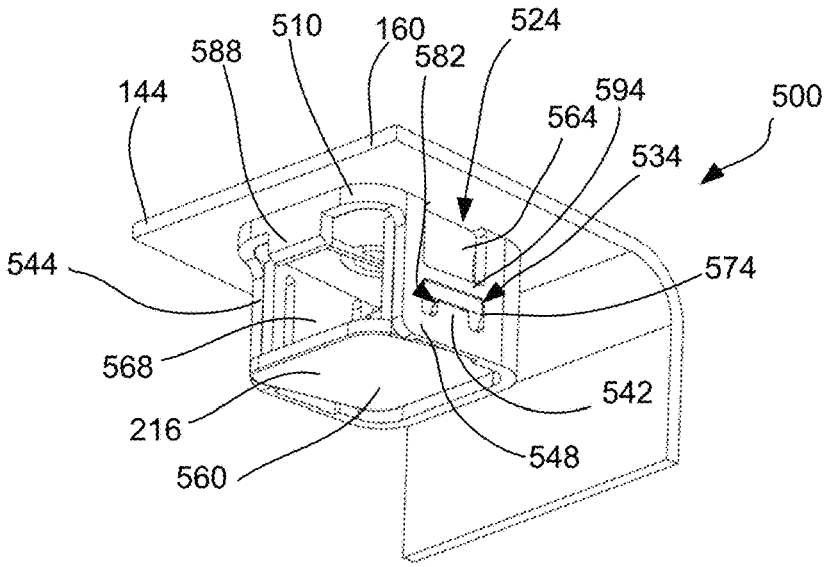
FIG. 19 illustrates a perspective view of the housing shown in FIG. 17 in which the release device is received in a second configuration.

The dispenser 500 includes a housing 510 having a pair of channels 520, 524 and apertures 530, 534 that include parapets 538, 542 extending upwardly therein. The parapets 538, 542 are located on respective first and second side members 544, 548 of the housing 510, and a passage 550 of the housing 510 extends between the first and second side members 544, 548. Similar to the housing 212 of FIGS. 2, 5-7, and 12-15, the housing 510 is located on and extends from the top end 160 of the sidewall 144 adjacent the opening 188, although other configurations are possible. Referring to FIGS. 17-19, a release device 560 of the second embodiment comprises a pair of corresponding tabs 564, 568 that each include a post 574, 578, respectively, extending outwardly therefrom. The posts 574, 578 each have a recess 582, 586 that is shaped to receive the corresponding parapet 542, 538, respectively, when in the second configuration. Similar to the release device 200 of FIGS. 1, 2, and 8-15, the release device 560 of FIGS. 17-19 carries the first release feature 216 opposite the second release feature 220. As illustrated in FIG. 16, a stud 588 extends from the sidewall 144 of the housing 510 and is located approximately centrally between the pair of channels 520, 524 and the pair of apertures 530, 534.

When the release device 560 is in the first configuration, as shown in FIG. 18, the first release feature 216 is disposed in the opening 188 of the sidewall 144 (see FIG. 16) and the posts 574, 578 are received within the respective channels 520, 524 of the housing 510. As the release device 560 is translated within the housing 510, the posts 574, 578 of the tabs 564, 568 interact with the respective channels 520, 524 to help ensure correct alignment between the housing 510 and the release device 560 to achieve a linear, vertical translation.

Referring to FIGS. 16 and 18, the channels 520, 524 are dimensioned such that, once the release device 560 has been sufficiently translated to enable release of a locking tongue (not shown), the tabs 564, 568 are configured to abut bars 590, 594 of the respective channels 520, 524, thereby preventing any further downward translation of the release device 560 relative to the housing 510.

When the release device 560 is in the second configuration, as shown in FIG. 19, the first release feature 216 is positioned opposite the sidewall 144 while the second release feature 220 is disposed in the opening 188 of the sidewall 144 (see FIG. 16). Accordingly, the tabs 564, 568 of the release device 560 interact with the respective parapet 542, 538 (see FIG. 16) of the apertures 534, 530 of the housing to prevent movement of the release device 560 relative to the housing 510. More specifically, when the release device 560 is installed in the housing 510 in the second configuration, the parapets 542, 538 are received within the recesses 582, 586, as at least partially seen in FIG. 19.

It is further contemplated that in alternative embodiments, the release device may carry a plurality of apertures and/or channels configured to interact with corresponding projections and/or tabs of the housing, while still providing multiple configurations in which the release device and the housing interlock to open the dispenser.

Figure 20:
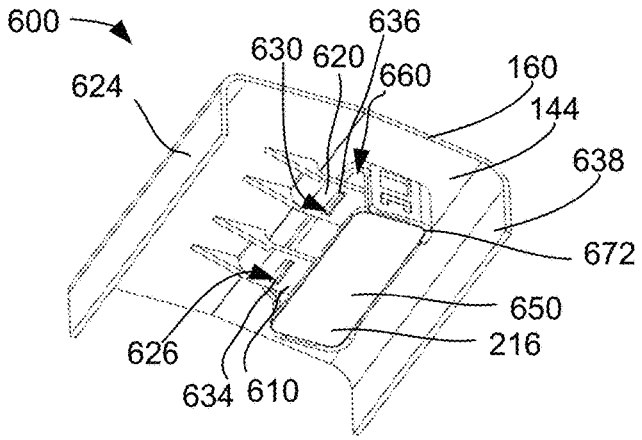
FIG. 20 illustrates a perspective view of a housing and a release device for a locking mechanism according to a further alternative embodiment.
Figure 21:
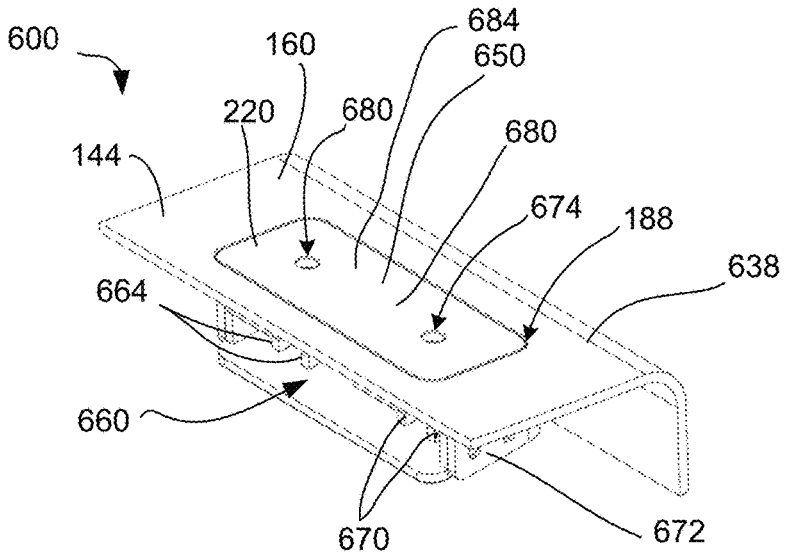
FIG. 21 illustrates a perspective view of the locking mechanism of FIG. 20 in which the release device is received in a second configuration.

A dispenser 600 according to a third embodiment is illustrated in FIGS. 20 and 21. This embodiment works in a similar way to the first and second embodiments described in FIGS. 1-19, but instead features a set of locking tongues 610, 620. For the sake of conciseness, only the differences between embodiments shall be described. Equivalent parts of the third embodiment use equivalent labels to that of the first and second embodiments.

As shown in FIG. 20, the front panel 624 in this embodiment comprises a pair of locking tongues 610, 620, each having a respective slot 626, 630 that is configured to receive a corresponding locking stud 634, 636 of the body 638 to secure the front panel 624 to the body 638 when the dispenser is in the closed state.

In the embodiment illustrated in FIGS. 20 and 21, a release device 650 is substantially rectangular in shape and is configured to receive the pair of locking tongues 610, 620 within a chamber 660. Similar to the release device 200 of FIGS. 1, 2, and 8-15 and also to the release device 560 of FIGS. 17-19, the release device 650 of FIGS. 20 and 21 carries the first release feature 216 opposite the second release feature 220. However, it shall be appreciated that in other embodiments, multiple release devices may be provided, such as, e.g., one for each locking tongue. As illustrated in FIG. 21, the chamber 660 of the release device 650 is provided with a plurality of sets of ridges 664, 670. The sets of ridges 664, 670 are configured to abut against the first and second locking tongues 610, 620, respectively, when the release device 650 is in in the first configuration and translated within a housing 672. Similar to the housing 212 of FIGS. 2, 5-7, and 12-15 and also to the housing 510 of FIGS. 16, 18, and 19, the housing 672 is located on and extends from the top end 160 of the sidewall 144 adjacent the opening 188, although other configurations are possible.

The release device 650 further comprises a plurality of key holes 674, 680 on a key wall 684 thereof, which comprise the second release feature 220. To facilitate release of the locking tongues 610, 620 when the release device 650 is in the second configuration, a user simply inserts a respective key into the respective key slots 680, 684, similar to the operation of the release device 200 and housing 212 of the dispenser 110, as described with reference to FIGS. 14 and 15. The key may comprise individual members for each key hole, or alternatively, may be a single key with multiple projections, each projection being configured to be received in one of the respective key holes.

Figure 22:
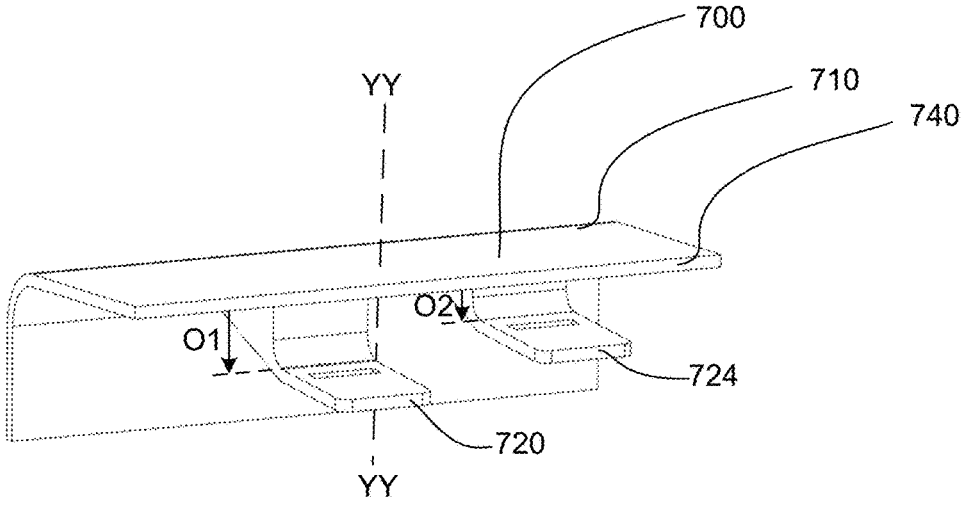
FIG. 22 illustrates a perspective view of a locking mechanism according to yet another alternative embodiment.
Figure 23:
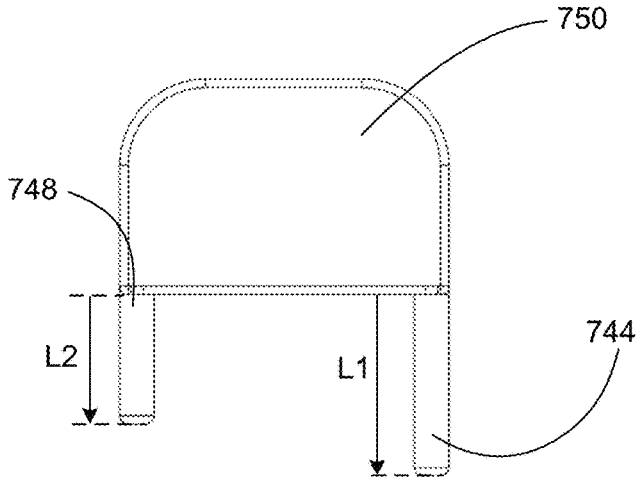
FIG. 23 illustrates a perspective view of a tool according to a further alternative embodiment for use with the locking mechanism shown in FIG. 22.

Referring to FIGS. 22 and 23, an alternative embodiment of a dispenser 700 includes a front panel 710 carrying a set of locking tongues 720, 724 arranged at different elevations for locking the front panel 710 to a body (not shown) of a dispenser 700. As illustrated in FIG. 22, the locking tongues 720, 724 are spaced from a perimeter 740 of the front panel 710 in a vertical direction that is parallel with a translation axis YY, with the first locking tongue 720 positioned a distance O1 from the perimeter 740 and the second locking tongue 724 positioned a distance O2 from the perimeter 740. Further, the locking tongues 720 and 724 are offset from another with respect to the perimeter 740 of the front panel 710. In the illustrated example, O1 is greater than O2, although other configurations are possible. In some embodiments, greater or fewer numbers of locking tongues may be provided on the front panel 710 and arranged at different elevations so as to be offset from one another. Referring to FIG. 23, a corresponding key 750 is depicted in FIG. 23, which includes a pair of members 744, 748 of different lengths, L1 and L2, that correspond to the distances O1 and O2 of the locking tongues 720, 724, respectively. In some embodiments, a key may be provided that includes greater or fewer members for engaging locking tongues arranged at different elevations.

It is contemplated that the locking tongues 720, 724 and key 750 may be used with the release device 650 and, thus, the respective members 744, 748 can be inserted into respective key holes 680, 684 of the release device 650 so each of the locking tongues 720, 724 is deflected to enable release of the front panel 710 from the body (not shown). The offset arrangement of dual locking tongues 720, 724 increases the amount of force and/or manipulation required to open the dispenser 700 and, thus, tampering is further prevented by this embodiment.

Although one or more preferred embodiments have been described, it will be appreciated that various changes or modifications may be made without departing from the scope defined in the appended claims.

The invention claimed is:

1. A dispenser, comprising:

a body coupled to a front panel to form an interior cavity, wherein the body includes a sidewall extending from a back portion, wherein an opening is formed through the sidewall at a location spaced apart from the back portion, and wherein a housing extends from the sidewall adjacent the opening and into the interior cavity; and a lock that is configured to be received within the housing in a first orientation or a second orientation, the lock having a wall that is positioned within the opening in the second orientation, and wherein the wall includes a receptacle formed therethrough.

2. The dispenser of claim 1, wherein the lock includes a chamber that is configured to receive a latch of the front panel.

3. The dispenser of claim 2, wherein, in the second orientation, the wall of the lock is disposed substantially flush with the sidewall.

4. The dispenser of claim 3, wherein the latch of the front panel is configured to be deflected by insertion of a portion of a key through the receptacle.

5. The dispenser of claim 4, wherein the lock includes a plurality of projections that are configured to engage a plurality of apertures of the housing, such that the lock is prevented from movement relative to the housing.

6. The dispenser of claim 2, wherein the lock includes a button wall that is positioned within the opening in the first orientation.

7. The dispenser of claim 6, wherein, in the first orientation, the button wall is disposed substantially flush with the sidewall and the lock is configured to be depressed to deflect the latch.

8. The dispenser of claim 1, wherein the sidewall of the housing includes at least one transparent window and at least one translucent portion.

9. The dispenser of claim 1, wherein the lock is a unitary component.

10. A dispenser, comprising:

a body coupled to a front panel to form an interior cavity, wherein the body includes a sidewall extending from a back portion, wherein an opening is formed through the sidewall at a location spaced apart from the back portion, and wherein a housing extends from the sidewall adjacent the opening and into the interior cavity; and a lock that is configured to be received within the housing in a first orientation or a second orientation, the lock having a wall that is positioned within the opening in the first orientation, wherein a latch carried by the front panel is configured to be positioned within the lock in the first orientation and the second orientation.

11. The dispenser of claim 10, wherein a first release feature is exposed through the opening in the first orientation and a second release feature is exposed through the opening in the second orientation.

12. The dispenser of claim 11, wherein the first release feature and the second release feature are configured to release the front panel from the body.

13. The dispenser of claim 12, wherein the first release feature is a button that is configured to be depressed into the housing.

14. The dispenser of claim 13, wherein the second release feature is a key receptacle that is configured to receive a key.

15. The dispenser of claim 10, wherein the lock is configured to be flipped over to transition between the first orientation and the second orientation.

16. A dispenser, comprising:

a body coupled to a front panel to form an interior cavity, wherein the body includes a sidewall extending from a back portion, wherein an opening is formed through the sidewall at a location spaced apart from the back portion, and wherein a housing extends from the sidewall adjacent the opening and into the interior cavity, the housing having a first rail and a second rail; and a lock that is configured to be received within the housing in a first orientation or a second orientation, the lock having a first hook and a second hook, wherein the first hook is configured to engage the first rail in the first orientation and the second hook is configured to engage the first rail in the second orientation.

17. The dispenser of claim 16, wherein the front panel is pivotable about a hinge between a closed position and an open position, the housing being located at an end of the dispenser that is opposite the hinge.

18. The dispenser of claim 17, wherein the first rail and the second rail of the housing are arranged coplanar with one another and extend from the housing in opposite directions relative to one another.

19. The dispenser of claim 18, wherein, when the lock is in the first orientation and the front panel is in the closed position, the lock is configured to be translated along the first rail and the second rail of the housing.

20. The dispenser of claim 18, wherein, when the lock is in the second orientation and the front panel is in the closed position, the lock is configured to be prevented from translation along the first rail and the second rail of the housing.

* * * * *